United States Patent [19]

Valentine

[11] 4,002,409

[45] Jan. 11, 1977

[54] CHAIN FEED CONTROL LOGIC FOR A MULTI-MODE COPIER/DUPLICATOR

[75] Inventor: William L. Valentine, Rochester, N.Y.

[73] Assignee: Xerox Corporation, Stamford, Conn.

[22] Filed: Apr. 1, 1975

[21] Appl. No.: 564,172

[52] U.S. Cl. ..... 96/1 R; 355/14

[51] Int. Cl.[2] ..... G03G 15/00

[58] Field of Search ..... 355/14, 17, 13, 3 R

[56] References Cited

UNITED STATES PATENTS

| | | | |
|---|---|---|---|
| 3,501,236 | 3/1970 | Maloney et al. | 355/14 |
| 3,734,604 | 5/1973 | Szostak et al. | 355/14 |
| 3,770,345 | 11/1973 | Kawakubo et al. | 355/14 X |

*Primary Examiner*—R. L. Moses

[57] ABSTRACT

An apparatus and method for producing copies of documents successively fed into a copier/duplicator in a chain feeding mode of operation. The copier/duplicator operates in a plurality of modes including a large document copying mode, a base mode and a chain feeding mode. The chain feeding control circuit comprises a separate counter means for keeping track of a first copy paper being processed while a second copy paper is tracked by a separate counter means. The apparatus and method permits copies to be chain fed in quick succession so that the second document may be exposed immediately after the first document has completed exposure.

26 Claims, 22 Drawing Figures

BASE LOGIC
300
LATCHES
COIN
DEV
CHARGE
PROG. CLK.
COINGO
BASE EXPOSE
INITIALIZATION CIRCUIT
320
BILLING CIRCUIT
602
318
MASTER COUNTER
600
MOTION SENSING LOGIC
606
JAM LOGIC
608
FAILSAFE TIMER
604
POWER DOWN LOGIC
LDC LOGIC
302

400
402
408
410
406
CHAIN FEED LOGIC

318
PROGRAM COUNTER
ADAPTIVE FUSER CONTROLLER
306A
FUSER COUNTER
405
CYCLE OUT LOGIC 00
01
215
a
b
c
d
LD2
360
330
LD3
LD4
LD5
LD7
330
220
242
362
213
ONE SHOT
Q̄
Q
S̄
LDC
EXPOSURE
LATCH
Q
D
264
214
246
283
299
263
284
LD 20a
L520
LD 20a
342
342
00
L 526
LD2
LD3
LD4
LD5
LD7
01

00
ADD PAPER
01
COINF SET
02
LDC BILLING
161
EXPOF MPX (PRINT DISABLE)
320
INHIBIT INITIALIZATION CIRCUIT
INITIAL
PRINT
121M
2:1 PRINT DISABLE MUX
A
C
B
Y
162
DEVF MPX
122M
2:1 COINCIDENCE/DEVELOP MUX
+5VDC
LD2
163
LDC DEV BIAS
RESET MPX
123M
2:1 DEVELOP BIAS/MUX
LD7
LD5
164
SCAN MPX
124M
2:1 SCAN SOLENOID MUX
LD4
04
DONE L
165
360
330
LD3

DONE LATCH
Q
S
D
a
b
221
222
2844
L505
111
113
330
L542
L540
09
010
012
013
014
015
016
L529
L528
L526
462
464
121
215'
231
281
217
L524
130
460
466
L520
L525
LD20a
342
L540a
LD17a
LD16
LD13
01
10
34
2
06

U74
U67
U71
+18VDC
366
EXP. MUX
B
165
MAIN DRIVE MPX
166
FUSER MPX
334
CHARGE MPX
168
06
07 LDC
08 LDC ONE SHOT CLR
09 LDC EXPOF
010 DEV SET LDC
011 LDC 13 + COIN RESET
012 LDC MAS CTR CLR
013 HOME+L
014 PRW INIT+L
015 141 DISABLE
016 LDC EXT SHUT DN
334
Y
2:1 EXPOSE MUX
125M
2:1 MAIN DRIVE MUX
126M
2:1 FUSER MUX
127M
2:1 CHARGE MUX
128M
A
B
C
EXP MPX
LDC EXPOF
EXPOF
+5VDC
LD3
LD16
330
165
360
362
04
360
LD3
370
328b
328a
LD16
L542
330
06
09
010
012
013
014
015
016

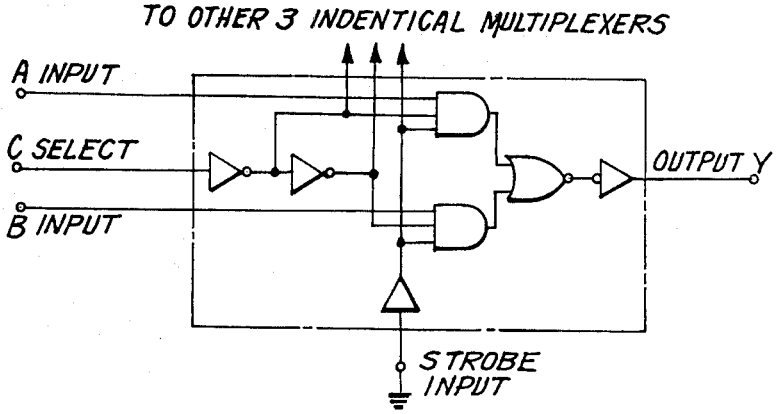
| TRUTH TABLE WITH STROBE GROUNDED | | | |
|---|---|---|---|
| C | A | B | Y |
| H | X | H | H |
| H | X | L | L |
| L | H | X | H |
| L | L | X | L |
X=DON'T CARE
(REF.) TEXAS INSTRUMENTS QUAD DATA MUX TYPE SN74157 OR EQUIVALENT
Fig. 16A.
Fig. 16D.
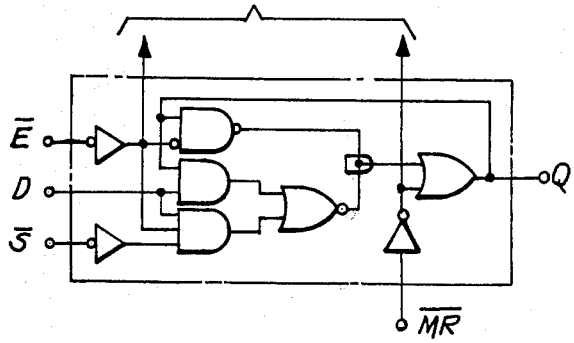
(REF.) FAIRCHILD OR MOTOROLA QUAD LATCH TYPE TTL/MSI 9314 OR EQUIVALENT
| TRUTH TABLE | | | | | |
|---|---|---|---|---|---|
| | INPUT | | | | OUTPUT |
| OPERATION | $\overline{MR}$ | $\overline{E}$ | $\overline{S}$ | D | $Q_n$ |
| D MODE | 1 | 0 | 0 | 0 | 0 |
| | 1 | 0 | 0 | 1 | 1 |
| | 1 | 1 | X | X | $Q_{n-1}$ |
| R/S MODE | 1 | 0 | 0 | 0 | 0 |
| | 1 | 0 | 0 | 1 | 1 |
| | 1 | 0 | 1 | 0 | 0 |
| | 1 | 0 | 1 | 1 | $Q_{n-1}$ |
| | 1 | 1 | X | X | $Q_{n-1}$ |
| DEVICE RESET | 0 | X | X | X | 0 |
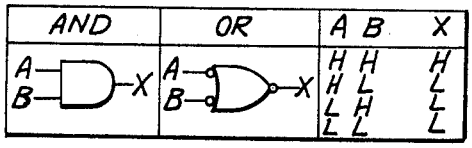
Fig. 16B.
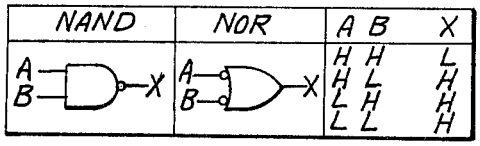
Fig. 16C.

CHAIN FEED CONTROL LOGIC FOR A MULTI-MODE COPIER/DUPLICATOR

CROSS REFERENCE TO RELATED APPLICATIONS

Reference is made to the following prior disclosures in which subject matter relating to the basic mechanical and electrical features of copier/duplicators having fixed and movable optical systems is disclosed as well as the overall operating modes of copier/duplicators having large document copying capabilities: Ser. No. 284,687 filed Aug. 29, 1972 (now abandoned) and continuation application Ser. No. 367,996, filed June 7, 1973, now U.S. Pat. No. 3,900,258; Ser. No. 393,546, filed Aug. 31, 1973 (now abandoned) and continuation application in the name of L. R. Sohm entitled "Dual Mode Control Logic For A Multi-Mode Copier/Duplicator" filed in Nov., 1974 (D/73383C). Reference is also made to concurrently filed applications in the name of Thomas J. Mooney entitled "Adaptive Fuser Controller", Ser. No. 564,173 and in the name of W. L. Valentine entitled "Cycle-Out Control Logic In A Multi-Mode Copier/Duplicator", Ser. No. 564,171, both applications assigned to the same assignee as the instant invention.

BACKGROUND OF THE INVENTION

1. Field of the Invention

The invention is in the field of photocopy machines and copier/duplicator machines which have multiple modes of operation. In particular, the invention pertains to copier/duplicators having a chain feeding mode of operation for making copies of documents successively fed into the machine.

2. Description of the Prior Art

Multi-mode copier/duplicator machines are known in the prior art and may, for example, utilize fixed and movable optical systems for operation in different modes such as a BASE Mode and Large Document Copying (LDC) Mode, respectively. In the BASE Mode of operation, documents up to 8½ × 14 inches may be copied, whereas in the Large Document Copying Mode, documents up to 18 × 14 inches may be copied. An example of such machines is described in detail in copending application Ser. No. 367,996, filed June 7, 1973, and Ser. No. 528,163 filed Nov. 29, 1974 (D/73383C). In such machines, it is advantageous to reduce the time at which subsequent copies of original documents may be fed into the machine so as to achieve a faster chain feeding mode of operation particularly when the most utilized small documents (8½ × 11 inches) are employed. However, with multi-mode machines which copy both large and small documents, it has been a problem to reduce the time between successively fed "small" documents, and, to utilize the same control circuitry for large documents which, of necessity, require longer times for the xerographic and bookkeeping functions to take place. In these prior art machines, a single, master counter, controlled all of the pertinent xerographic functions including charge, exposure, development, fusing, jam detection, and billing. It has thus been necessry to wait for all of these pertinent functions to be initiated and/or completed before a subsequent document original could be processed. In effect, copier/duplicators utilizing a small paper cassette for 8½ × 11 inches copies would be strapped to the same time constraints imposed for large document sizes. As a consequence, substantial time is wasted, particularly in waiting for the jam sensing and billing functions to be completed.

SUMMARY OF THE INVENTION

It is an object of the instant invention to overcome the disadvantages of the prior art by providing a chain feeding control logic which is substantially faster for small paper sizes than for large paper sizes to permit a more rapid chain feeding mode of operation.

Another object of the invention is to provide an efficient chain feeding control logic which is compatible with the control logic of multi-mode copier/duplicators.

It is another object of the invention to provide two separate counter means run simultaneously and independently in order to control the transport of two sheets of copy paper thereby permitting a more rapid chain feeding operation.

A further object of the invention is to provide a control logic circuitry so as to allow a chain feeding mode of operation to take place in a minimum time.

Yet a further object of the invention is to permit a chain feeding mode of operation wherein a second document may be exposed immediately after termination of exposure of a first document.

The invention pertains to a chain feeding control logic circuit for use in a multi-mode copier/duplicator having both Large Document Copying (LDC) capabilities as well as small document copying capabilities. The LDC Mode of operation may utilize a large or small paper cassette. For the Large Document Copying Mode using a Large Cassette (LDC/LC), a single counter means, the master counter is utilized to control all xerographic functions including jam detection and billing. In the LDC - Small Cassette Mode (LDC/SC) a master counter and a separate program counter are employed. The two counters are clocked in parallel, but independently operated so that on occurrence of a subsequently fed original document, the master counter is immediately utilized to control copy processes associated with the subsequently fed document, whereas the program counter continues to track the copy already in process through completion of jam detection and billing functions.

BRIEF DESCRIPTION OF THE DRAWINGS

Other objects and features of the invention will become more readily apparent from the following detailed description when read in conjunction with the accompanying drawings, in which like reference numerals designate like parts throughout the figures thereof, and wherein:

FIGS. 5A–5B are timing diagrams showing the sequence of operations of the copier/duplicator in the chain feed mode of operation utilizing a small cassette;

FIGS. 16A–16D illustrate circuit details and truth tables associated with key logic elements of the instant invention.

DETAILED DESCRIPTION OF THE PREFERRED EMBODIMENT

1. Mechanical Overview of the Multi-Mode Copier/-Duplicator

Figure 1:
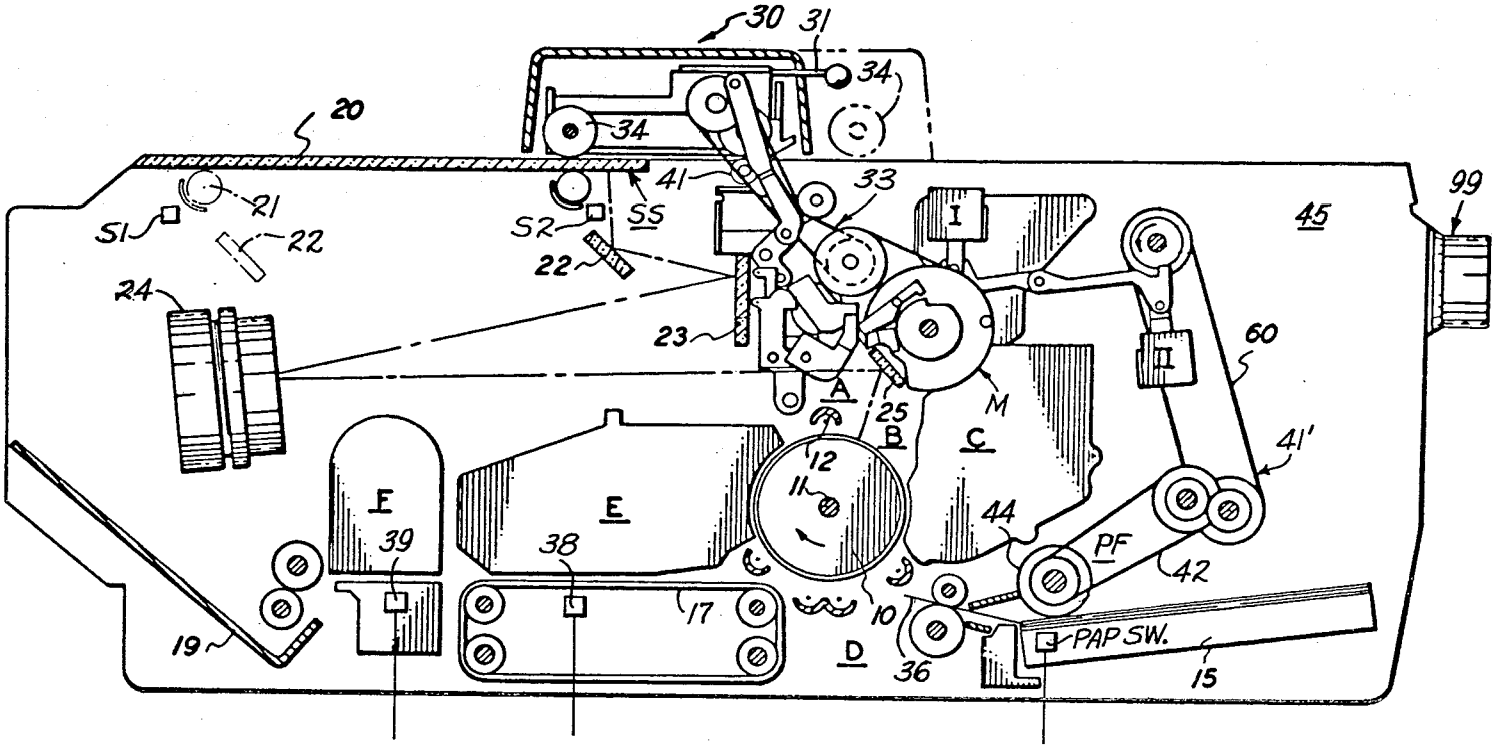
FIG. 1 is a schematic side view of a copier/duplicator in which the chain feeding control logic of the instant invention may be utilized.

The control circuitry of the present invention will be described in the context of a xerographic copier/duplicator machine of a specific design. However, it should be noted from the outset that although the description is in the context of the xerographic machine, the scope of the present invention is not limited to the xerographic machine. Clearly as will be evident from the following description, the principles of the present invention can be applied to other types of machines having similar operational requirements. Now referring to the drawings, as shown in FIG. 1, a xerographic copier/duplicator machine typically includes various elements for implementing xerographic steps. It comprises a drum 10 that may be driven clockwise about an axis 11. The drum includes a photosensitive insulating layer surface 12 around the periphery of which various controlled elements are situated; namely, charging station A, imagewise exposing station B, developing station C, image transfer station D, cleaning station E, and fusing station F, etc., for effecting the usual steps involved in making xerographic copies. The machine may be further provided with a suitable feeding means PF for feeding copy sheets of paper from a paper supply in a cassette 15 and a suitable paper transfer means 17 for transferring the imaged paper onto the fusing station F where the toner image is fused onto the paper and then feed out to a suitable receptacle means 19.

The xerographic copier/duplicator machine may be designed to operate in different modes. In a first, or BASE Mode, conventional documents up to a certain size are copied and in a second, or LDC Mode, larger size documents are processed. For example, in the BASE Mode, the machine is designed to employ a moving optical scanning arrangement 21–24 to scan a stationary original placed on a platen 20 in making copies up to 14 inches in length and 8.5 inches in width. In the LDC Mode, the scanning arrangement is held at a stationary position, and the document original is moved past a scanning station SS. In the LDC Mode, document originals up to 14 inches by 18 inches may be copied.

Figure 2:
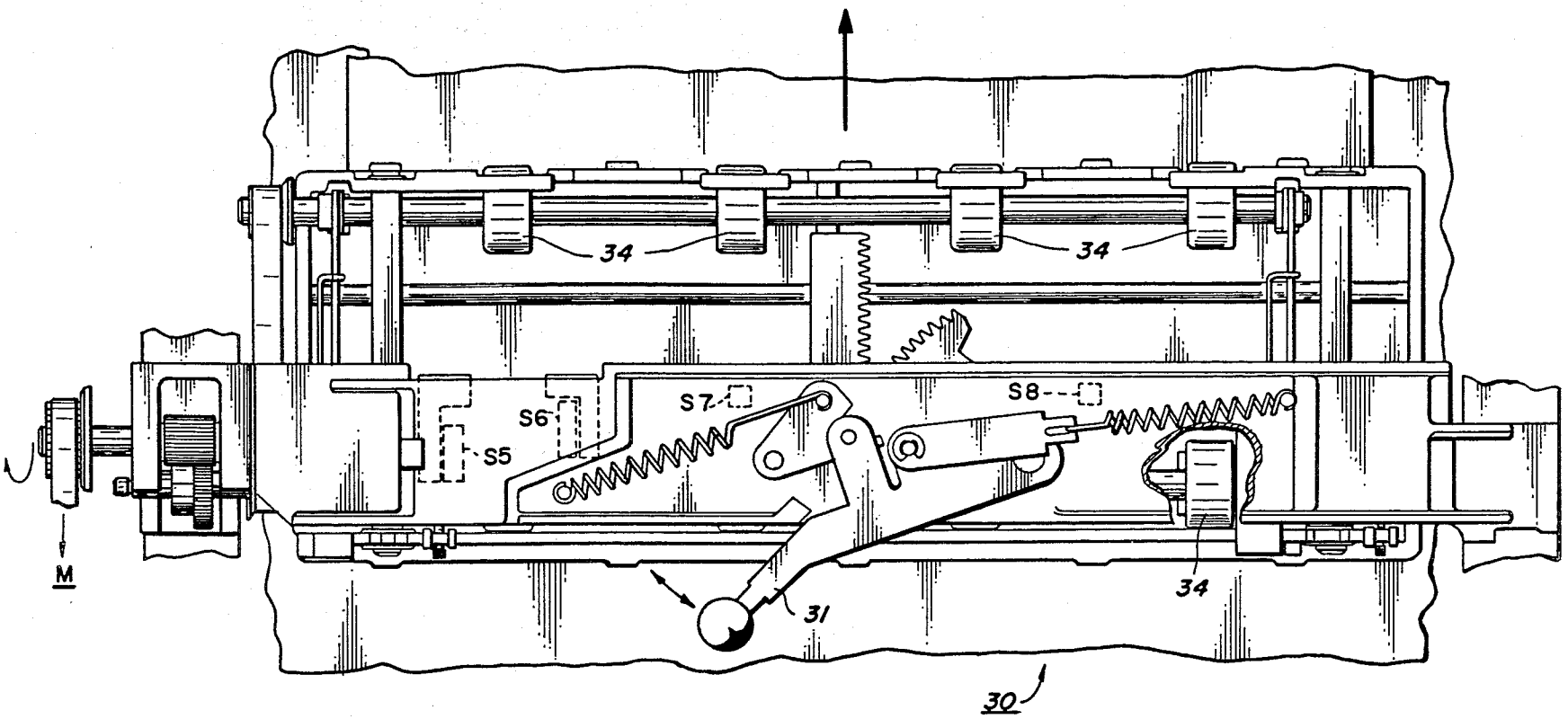
FIG. 2 shows a schematic top view of the document feeding means that may be used as an accessory to the base machine when the machine is operating in the LDC Mode.
Figure 3:
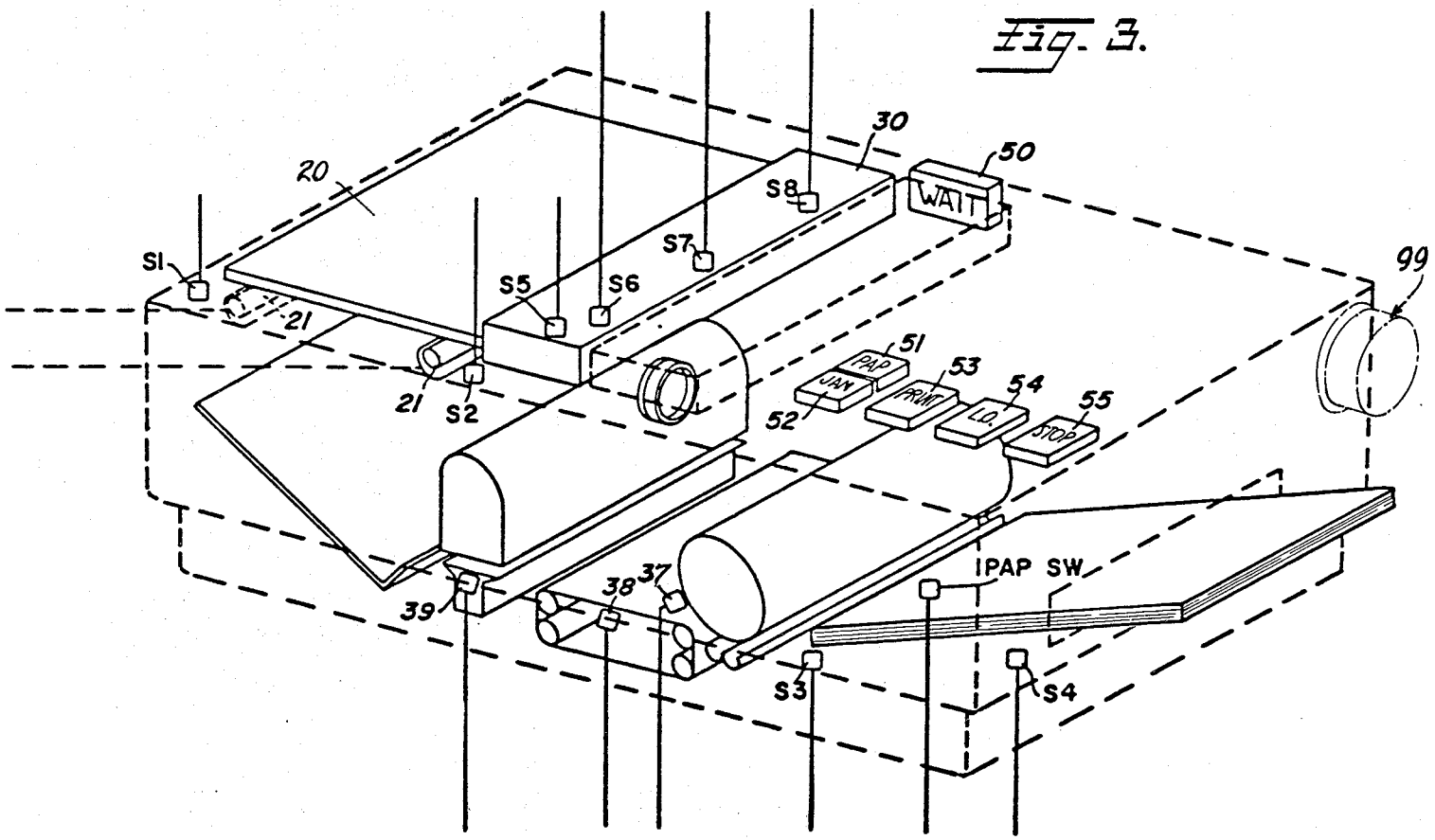
FIG. 3 shows a perspective view of the copier/duplicator of FIG. 1 illustrating the position of control switches and sensing elements.

Referring to FIGS. 1–3, in BASE Mode operation, the scanning arrangement 21 is moved across the width of the platen 20 by a carriage (not shown) so that the associated optical means 22–25 projects the image of the original on the xerographic drum surface 12 at the image exposing station B. In BASE Mode operation, the machine is designed so that, in each copy run after an initial warm-up period, each successive xerographic copying cycle is accomplished in the same given time interval. The cycle time starts as the scanning means leaves the start scan position near the Home Switch S1 and continues to move past the platen and ends as it reaches the end of scan position at the End of Scan Sensing Switch S2. The next cycle begins as the scanning means automatically flies back to the home or start scan position. In BASE Mode, the operator may initiate a multiple copy mode by setting dial 99 to the desired number of copies.

In the LDC Mode of operation, a large document original is fed through a feeding means 30 such as that shown in a pending U.S. application Ser. No. 205,911 filed on Dec. 8, 1971, or in the U.S. Pat. No. 3,731,915 issued to Guenther. For example, as shown in the aforementioned copending application Ser. No. 284,687, the document feeding means 30 may be stationed outside of the platen 20 and be in a disengaged position when the machine is to operate in the BASE Mode as shown in dotted lines of FIG. 1. It includes a lever 31 which is designed so that by moving it clockwise the feeding means 30 is brought into or engaged into a position as shown in solid lines so that it can operate in the LDC Mode. In this position, the document original can be fed past the scanning station SS. A suitable mechanism 33 is provided in the machine for coupling feed rollers 34 to the main drive M when the document feeding means 30 is moved to the LDC position. Once engaged, the rollers 34 driven by the main drive M feeds the document original to the left past the scanning station SS. The speed with which the paper is fed past the scanning SS is synchronized with the speed with which the copy paper 36 from the paper cassette 15 is fed into a transfer relationship with the photosensitive insulating layer 12 by a suitable paper feeding means PF. When it is desired to operate the machine in the BASE Mode, the document feeding means is simply moved out of the way of the platen by rotating the lever 31 counter-clockwise rotation. The counter-clockwise rotation of the lever 31 moves the document feeding means 30 to the right as shown in dotted lines and out of the path of the scanning station SS. At the same time, the driving mechanism 33 disengages the feed rollers 34 from the main drive M to render the document feeding means inoperative. While in the illustrative embodiment, it is shown that the document original feeding means is moved from one position to another to engage or disengage the machine in the LDC Mode, it need not be so limited. For example, the document feeding means could be held at a fixed stationary position using suitable actuating means such as a push button to engage or disengage document feed rollers and thus selectively engage the feeding means for the LDC Mode.

In the BASE Mode, a control circuitry of a conventional design may be used to provide signals necessary for the selective enabling of certain elements such as charging, exposing, developing, image transferring, fusing and cleaning means that implement the steps necessary in making a copy. The circuitry may be of electro-mechanical or electronic components such as that shown in the U.S. Pat. No. 3,301,126 issued to R. F. Osborne et al on Jan. 31, 1967, or that shown in the pending application Ser. No. 348,828 filed on Apr. 6, 1973, now U.S. Pat. No. 3,813,157,which acts to implement various xerographic process steps at appropriately timed intervals at various points in the processing operation under conditions where necessary timing is desired from a clock or cam mechanism or other suitable means. Generally, as described in the above mentioned copending application Ser. No. 367,996 for BASE Mode, the timing of the xerographic copying cycle is keyed to the scanning operation of the scanning means. Thus, in the BASE Mode, each cycle of xerographic processing steps during the making of successive copies in a copy run is keyed to the start and end of the scanning operation involving the movement of the scanner carriage between the home position (at Switch S1 in FIG. 1 or 2) and the end of scan position (at Switch S2 in FIG. 1 or 2).

In addition, the control circuitry is also provided with a suitable design such as that shown in the U.S. Pat. No. 3,588,472 issued to Thomas H. Glaster et al. on June 28, 1971 or in the U.S. patent application Ser. No. 344,322 filed on Mar. 23, 1973, now U.S. Pat. No. 3,832,065, for detecting various malfunctions of the machine. For example, referring to FIGS. 1 and 2, the machine may include a detack detecting means 37 for detecting the failure of copy paper separation from the drum surface 12, a jam detection means 38 for detecting a paper jam that may occur along the paper path, and heat sensing element 39 for monitoring the temperature of the fusing station F. The output of these detecting means form a part of the input signals to the control circuitry of the present system.

In the present machine, various sensing elements in the form of switches are used to provide certain necessary input signals to the control circuitry. These switches are shown schematically in FIGS. 1–3; Table 1 contains a brief functional description of each.

TABLE 1

Figures 4, 6, 7, 8, 9, 10, 11, 12, 13, 14, 15:
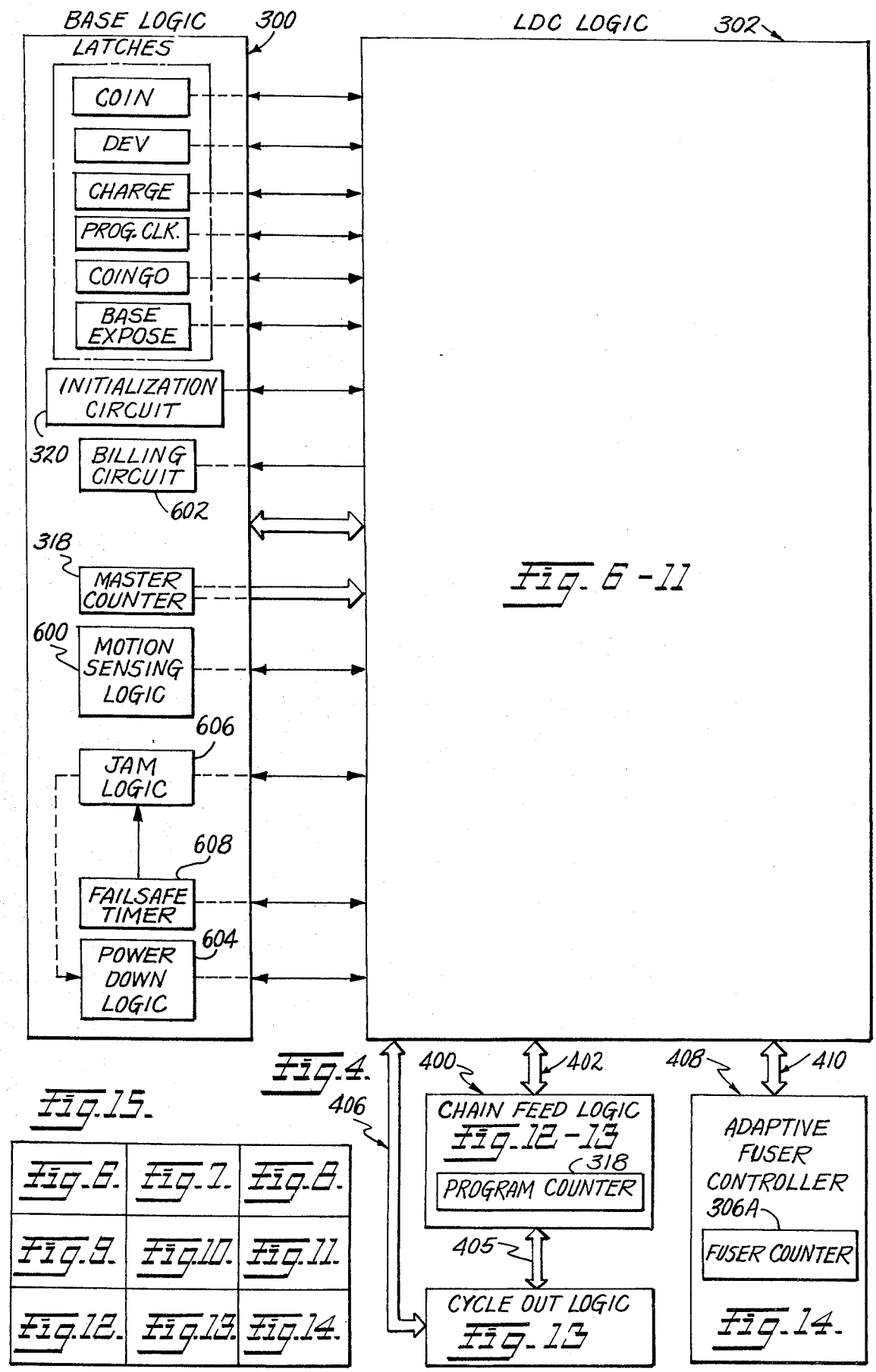
FIG. 4 is a block diagram of the chain feed control logic showing its interconnection to the multi-mode copier/duplicator.
FIGS. 6–14 show the detailed logic diagram of the chain feed control logic of the instant invention and its interconnection to the copier/duplicator.
FIG. 15 illustrates the arrangement of FIGS. 6–14 to form the detailed logic diagram.

FUNCTIONAL DESCRIPTION OF INPUT SWITCHES
(See FIGS. 1–3 for switch locations;
FIGS. 6 and 9 for switch interconnections)

| | |
|---|---|
| HOME SWITCH: | The Home Switch S1 is used for indicating that the optics scanning carriage is at the home or start position of the scan cycle. It is actuated when the optics scanning carriage is at the home position and provides two complementary outputs to the control logic circuitry. The outputs denote (in positive true logic terms) the "At Home" and "Off Home" condition of the optics scanning carriage. |
| END OF SCAN SWITCH: | The End of Scan Switch S2 is used to sense the presence of the optics scanning assembly at the end of scan position. It is normally deactuated and is actuated when the scanning assembly reaches the desired position. Upon actuation it provides a logical "0" level to the control logic. |
| TRAILING EDGE SWITCH: | The Trailing Edge Switch S3 is utilized to detect the trailing edge of a sheet of copy paper as it leaves feed rollers adjacent the paper cassette. It is normally deactuated and exhibits an open circuit. In the presence of copy paper it is actuated providing a logical "0"; on passage of the trailing edge it again opens removing the logical "0" from the control logic. |
| LARGE CASSETTE SWITCH: | The Large Cassette Switch S4 is utilized to sense the presence of the large paper cassette in the paper tray. It is normally deactuated; it actuates in the presence of the large paper cassette thereupon providing a logical "1" to the control logic. |
| MODE CHANGE SWITCH: | The Mode Change Switch S5 senses the movement of the document feeding means 30 into the LDC Mode position. It is normally in the open state. It closes momentarily as the document feeding means 30 moves into position for the LDC Mode of operation and starts the process of initializing the control logic circuitry. S5 is a one-way roll-over type switch that actuates in one way when the machine goes from the BASE Mode to the LDC Mode but not vice versa. It serves the function of the Print Button in initializing logic components in going from BASE Mode to LDC Mode. |
| LDC MODE SWITCH: | The LDC Mode Switch S6 is actuated as the document feeding means 30 moves to the LDC Mode position from BASE Mode position. It is normally open. On actuation, it provides a logical "0" to the control logic circuitry. The logical "0" from this switch indicates a mode change of the machine from the BASE Mode to the LDC Mode; and further, of the continued operation of the machine in the LDC Mode. |
| DOCUMENT SWITCHES: | The Document Switches S7 and S8 are utilized to sense the document original being fed into the copier. The switches are normally closed, are connected in series, and provide a logical "0" to the control logic. One or both switches open in the presence of the document original to signify its presence. When thus opened, the logical "0" is removed from the control logic. Operation of either one or both is utilized to signify the presence of the document original as well as the |

TABLE 1-continued

| FUNCTIONAL DESCRIPTION OF INPUT SWITCHES (See FIGS. 1–3 for switch locations; FIGS. 6 and 9 for switch interconnections) |
|---|
| leading and trailing edges of the document original. |

Briefly stated, the switches S1–S8 above are connected to operate and provide the following functions. The Home Switch S1 when actuated shows that the scan carriage is at the home position. The End of Scan Switch S2 is in a non-actuated condition at this point. Now suppose the operator wishes to operate the machine in an LDC Mode. The lever arm 31 is moved clockwise to place the document feeding means 30 to the left and thereby place the machine in the large document copying mode. As the lever arm 31 is rotated, the LDC Mode Switch S6 is actuated and then the switch S5 is momentarily actuated. This initializes the control circuitry for the LDC Mode of operation.

In response to such initializing, the control circuitry causes the scanning arrangement and associated optics to move into the LDC position, that is, to the end of the scan position associated with switch S2. Furthermore, the control logic associated with LDC Mode of operation is so designed that the action of copy paper feed solenoid II in selectively feeding copy paper is prevented or inhibited while the scanning elements 21 and 22 move to the end of the scan position. When the scanning elements reach the end of the scan position, this is sensed by the End of Scan Switch S2. In turn, the Switch S2 provides the End of Scan Signal. In response, the scanning and optic elements are retained in that position by a suitable pawl and ratchet mechanism. For a detailed discussion of an exemplary mechanism of this type, one may refer to the above mentioned copending application Ser. No. 367,996. This prevents the scan carriage means from automatically returning to the home switch position as is done in BASE Mode operations, and when the scanning means reaches the end of scan position, the main drive M drives the document original feed rollers 34.

In response to the end of scan signal, the control circuitry removes the constraints on the operation of the solenoid II to allow the copy paper feeding means PF to selectively operate. With the solenoid enabled, the drive belt means 41 and 42 are prevented from engaging with the main drive M and no copy paper is fed. When solenoid II is de-actuated by the control logic in response to an actuation of the Document Switches S7 and S8, as the document original passes thereby, the drive belt means engage and the main drive M is allowed to drive the copy paper feed rollers 44 in synchronism with the speed with which the document original is fed past the scanning station SS. The switches S7 and S8 actuate as the document original paper is fed therepast in the paper feeding means 30, and enables the control logic to proceed with LDC Mode of copying operation. Absent any malfunction, the machine proceeds to complete the copying operation.

There are a number of indicating means that may be provided in the copier/duplicator machine, as shown in FIG. 2, to provide the following functions:

| | |
|---|---|
| WAIT | This is a visual indication means 50. It is connected in a manner to provide the "Wait" indicia when document feeding means 30 is moved to the LDC position, and this condition is maintained by the control circuitry until the scanning element 21 moves to the end of the scan position and the machine is ready to make copies. The lighted indicating means 50 comes to the view of the operator during this time and alerts the operator to wait until the indication terminates before the document original sheet is fed through the feeding means 30. The indicating means 50 may include a suitable notation "WAIT" for the operator's convenience. Preferably, the light indicating means 50 may be positioned above the console of the base machine as shown in FIG. 2 at a position where it will be hidden behind the housing of the paper feeding means 30 when the same is positioned for BASE Mode operation. The Wait light comes on from the time of charging until exposure is turned off. |
| ADD PAPER | An indicating means 51 "ADD PAPER" is provided to apprise an operator that attention to the paper supply is necessary. It may be so connected that it is energized by the control circuitry when the paper supply runs out or when the incorrect size paper supply is present. |
| JAM OR CLEAR PAPER PATH | This indicating means 52 is provided to signify to the operator the paper jam condition is present and requires clearing. |

In addition, certain controls are provided in the machine for inputting particular command signals to the control circuitry. For example:

| | |
|---|---|
| PRINT | This input, button 53, is used to enable the operator to start the machine in the BASE Mode or in the alternative in the LDC Mode if the machine is already held in the LDC Mode. The Print button serves to actuate the Initialization Circuit to supply power to logic elements. |
| LIGHT ORIGINAL | This input, button 54, serves the function of starting the appropriate machine cycle when the original is light and it is desired to provide a darker copy. If the machine is in the BASE Mode, it may be placed in the LDC Mode by moving the lever arm clockwise and movement of the lever is accomplished by the operation of the momentary switch S5 and the LDC Mode Switch S6 to provide the print command signal. However, if the machine is already in the LDC Mode, then a depressing of either the PRINT button 53 or LIGHT ORIGINAL button 54 provides the print command signal. |
| COPY QUANTITY DIAL | This input, dial 99, is used to enable the operator to select the number of copies desired of a single original document. It is operative |

-continued

| | |
|---|---|
| | only in the BASE Mode of operation. |
| STOP | The STOP input, button 55, is used for stopping the machine in the middle of its operation and causes the control circuitry to stop the machine at the end of the copying cycle in process. |

The features tabulated above are common to many copier/duplicators well known in the art and their use in multi-mode copier/duplicators is more fully set forth in the above mentioned copending application of L. R. Sohm entitled "Dual Mode Control Logic For A Multi-Mode Copier/Duplicator" (D/73383C).

2. Block Diagram Description

FIG. 4 is a block diagram of the overall electronics associated with the multi-mode copier/duplicator having the chain feed logic circuitry of the instant invention. The copier/duplicator comprises a BASE LOGIC circuit 300 which comprises a plurality of latches (coincidence latch, development latch, etc) which form part of the copier/duplicator in its BASE Mode of operation. These latches control the basic xerographic processes which are well-known in the art. A plurality of other conventional circuits are shown in the BASE LOGIC 300 and are explained more fully below in connection with the Chain Feed Logic of the instant invention. The copier/duplicator also comprises a LDC LOGIC circuit 302 which modifies the BASE LOGIC circuitry to enable the copier/duplicator to photocopy large documents (14 × 18 inches). A detailed description of the interconnection of the LDC LOGIC 302 with the BASE LOGIC 300 is set forth in copending application, Ser. No. 528,163 filed Nov. 29, 1974 (D/73383C) mentioned above. The instant invention pertains to a Chain Feed Logic 400 which is shown interconnected to the LDC LOGIC 302 by a plurality of lines 402. In addition, Chain Feed Logic 400 is connected to a Cycle-Out Logic circuit 404 via lines 405, and the Cycle-Out Logic is connected to the LDC LOGIC 302 by a plurality of lines 406. Finally, an Adaptive Fuser Controller 408 is connected to the LDC LOGIC 302 by a plurality of lines 410. Both the Cycle-Out Logic 404 and the Adaptive Fuser Controller 408 form the subject of concurrently filed applications, namely, "Cycle-Out Logic in a Multi-Mode copier/duplicator" in the name of W. L. Valentine and "Adaptive Fuser Controller" in the name of Thomas J. Mooney, both applications assigned to the same assignee as the instant invention.

The following description emphasizes the features of the LDC LOGIC in 302 as well as the BASE LOGIC 300 which are particularly germane to the understanding of the Chain Feed Logic 400 of the instant invention.

3. Timing Diagram Description

Figure 5A:
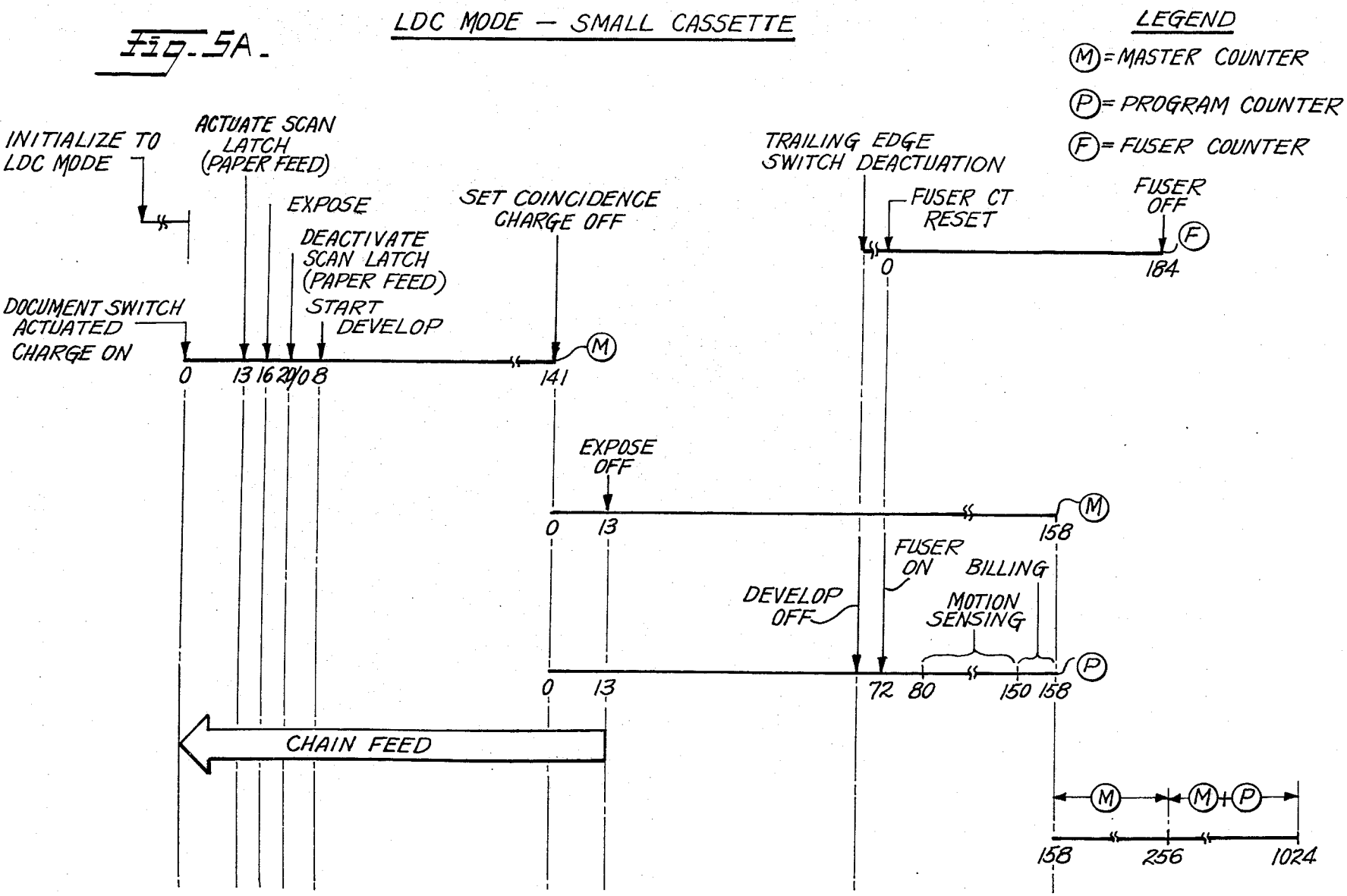
Figure 5:
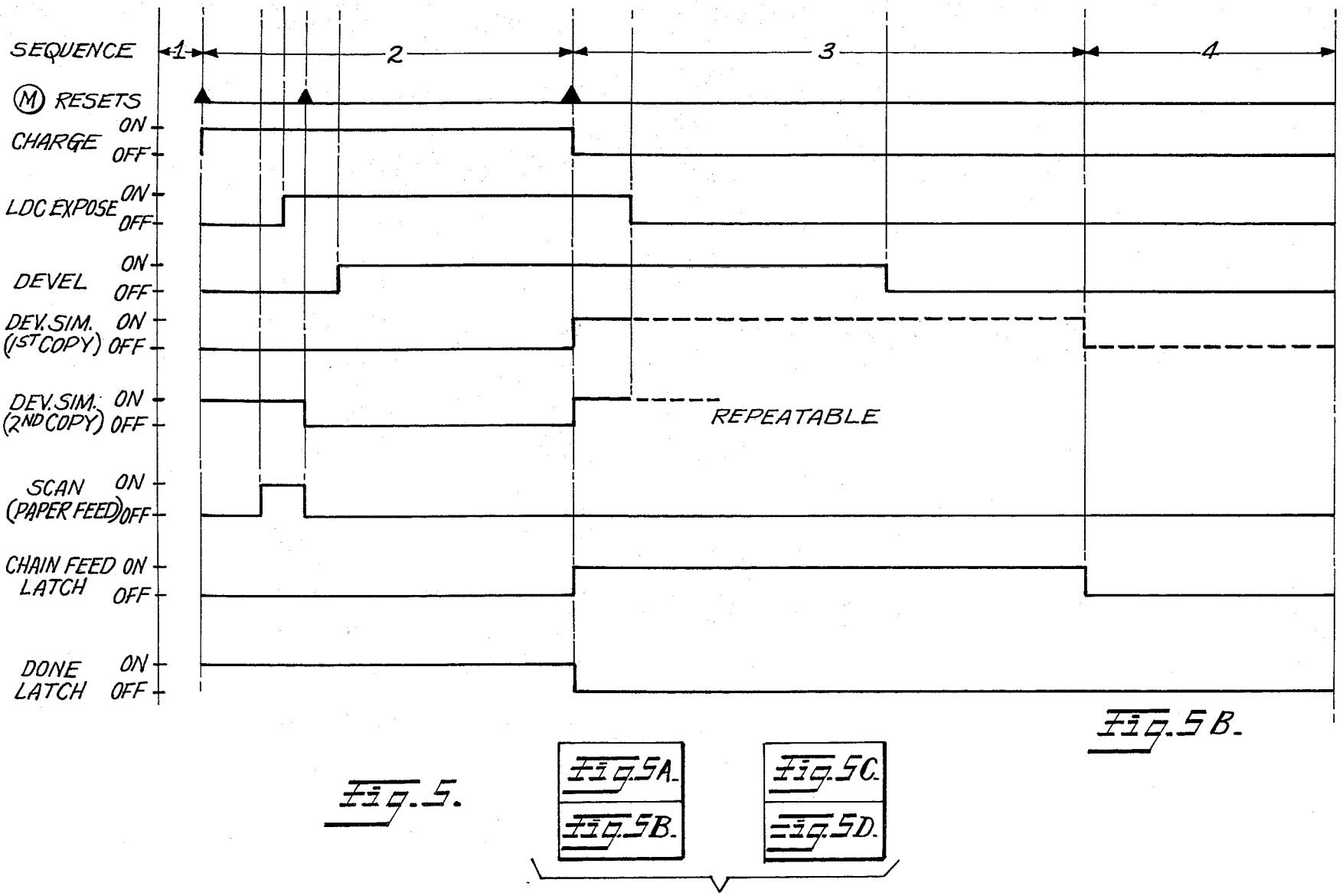
FIG. 5 illustrates the arrangement of FIGS. 5A–5D to form the timing diagram.

As may be seen by reference to FIGS. 5A and 5B, the chain feeding operation is divided into a plurality of time sequences in which different xerographic functions take place and different portions of the copy cycle are executed. The logic circuits utilized to control the xerographic functions are clock controlled and thus may be described in terms of the counter states of a Master Counter 318, Program Counter 316, and Fuser Counter 306A utilized to control machine parameters.

Figure 5C:
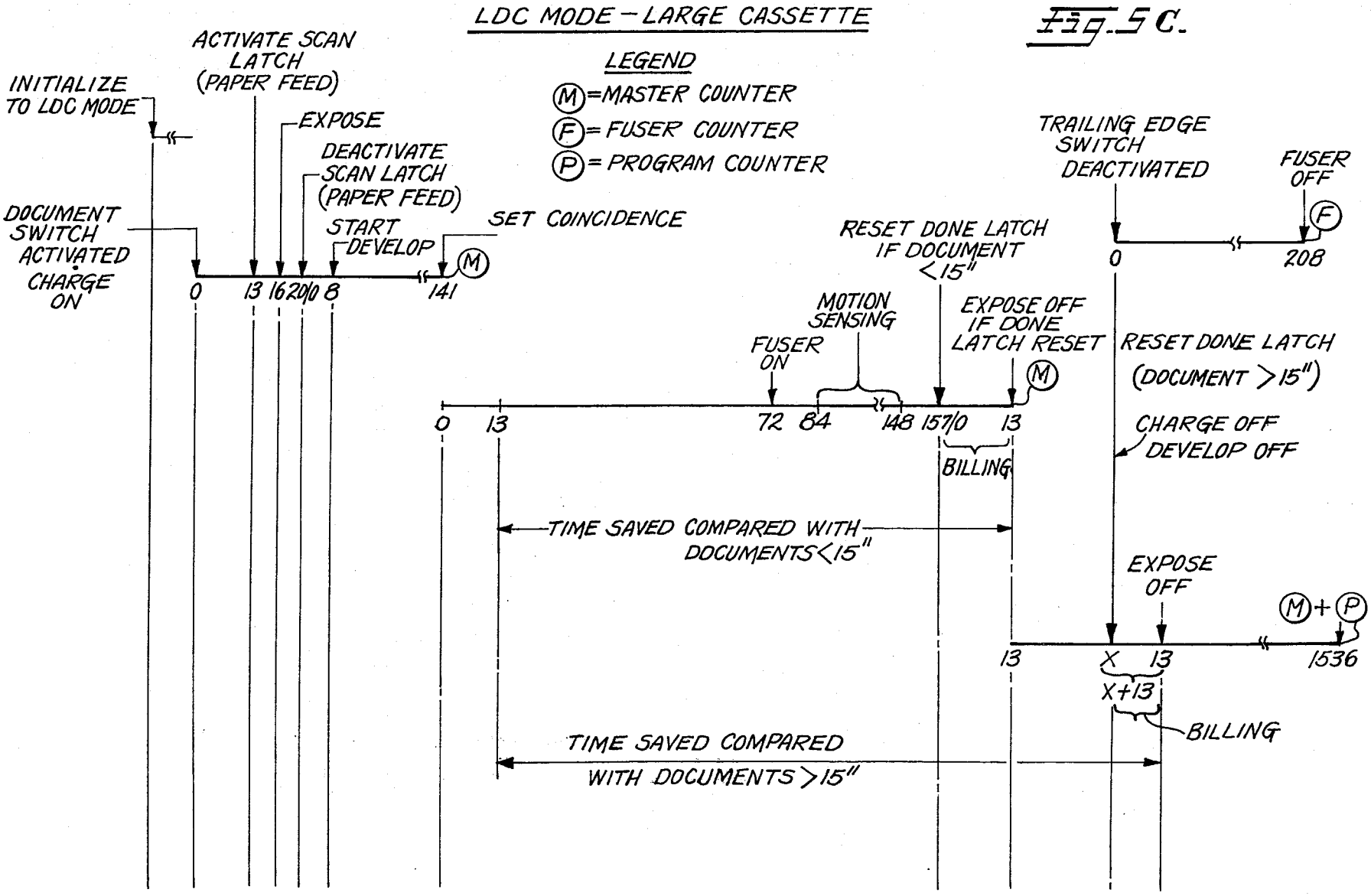
FIGS. 5C–5D are timing diagrams showing the sequence of operations of the copier/duplicator utilizing a large cassette.

As an example to illustrate the counter state description used herein, consider the designation $\overline{\text{CT72M}}$-SQ3. This designation indicates that the Master Counter (M = Master Counter, P = Program Counter, F = Fuser Counter) has accumulated 72 clock pulses, and the designation refers to the counter signals which are decoded in the conventional manner by sampling the pertinent stages of the Master Counter. Also in the usual notation, a "bar" is used to denote the logical inverse of the counter state; i.e., this particular signal will exhibit a low logic level (logical 0) on the accumulation of the 72nd clock pulse, when suitably decoded. The designation "SQ3" denotes the third sequence in a particular operating mode. Note for example that FIGS. 5A and 5C show the LDC Mode of operation consisting of four distinct sequences. When a particular sequence is further conditioned by size of the copy paper cassette, the appropriate designation is appended to so indicate by the addition of "/SC" or "/LC" denoting Small Cassette or Large Cassette Modes respectively.

It is noted that the Large Document Copying Mode enables the document feeding means 30 to convey subsequently fed documents into the copier/duplicator. In this sense, both the LDC/LC (Large Document Copying/Large Cassette) Mode as well as the LDC/SC (Large Document Copying/Small Cassette) Mode may be thought of as chain feeding modes of operation. In another sense, inasmuch as a second separate counter (the Program Counter) is utilized to run in parallel with the Master Counter, only in the LDC/SC Mode of operation, the main time saving advantages of the chain feeding copier/duplicator are most noticeable when utilizing the machine in the LDC/SC Mode. Thus, the LDC/SC Mode is often referred to as the chain feeding mode of operation.

Figure 5D:
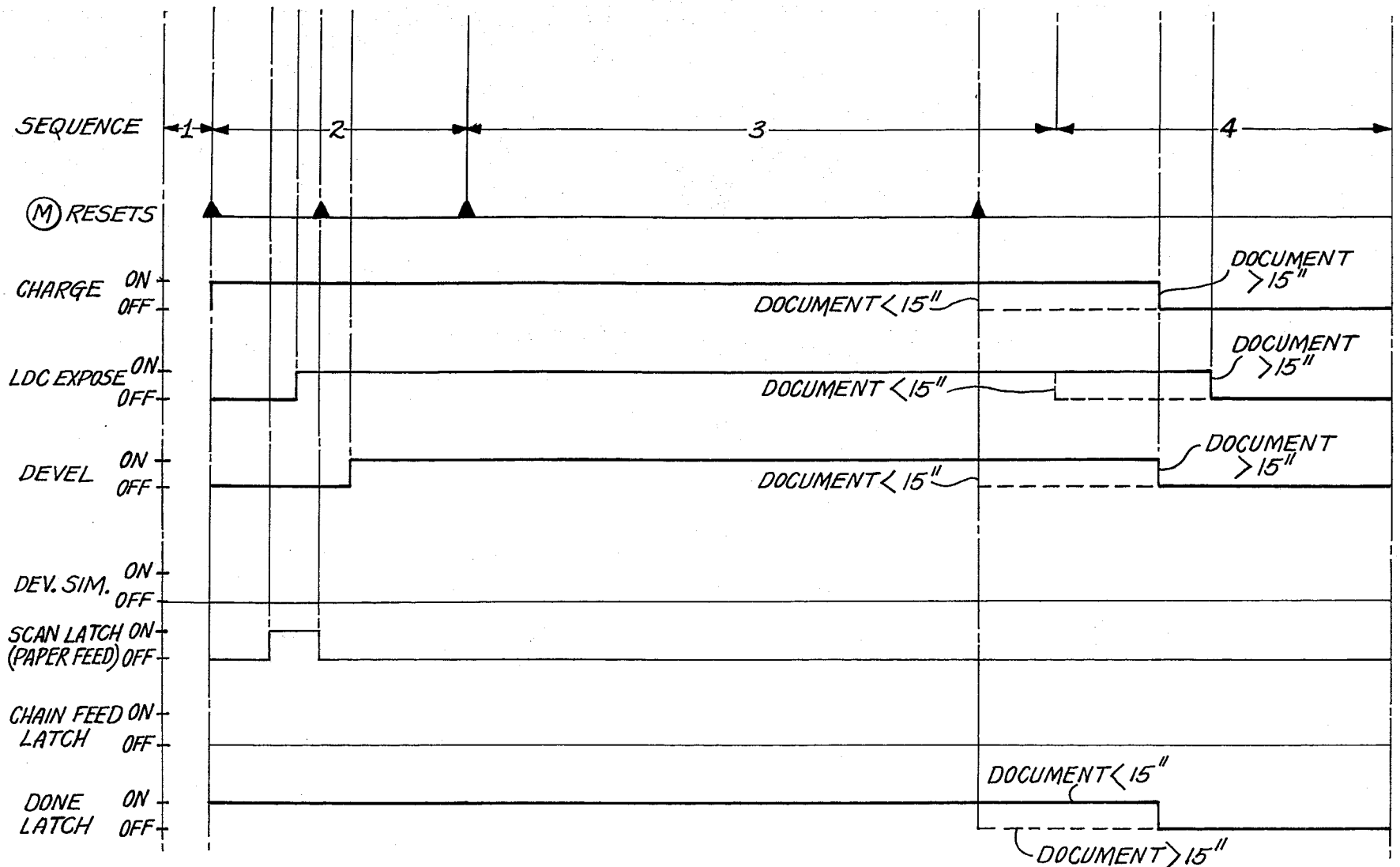
Figure 8:
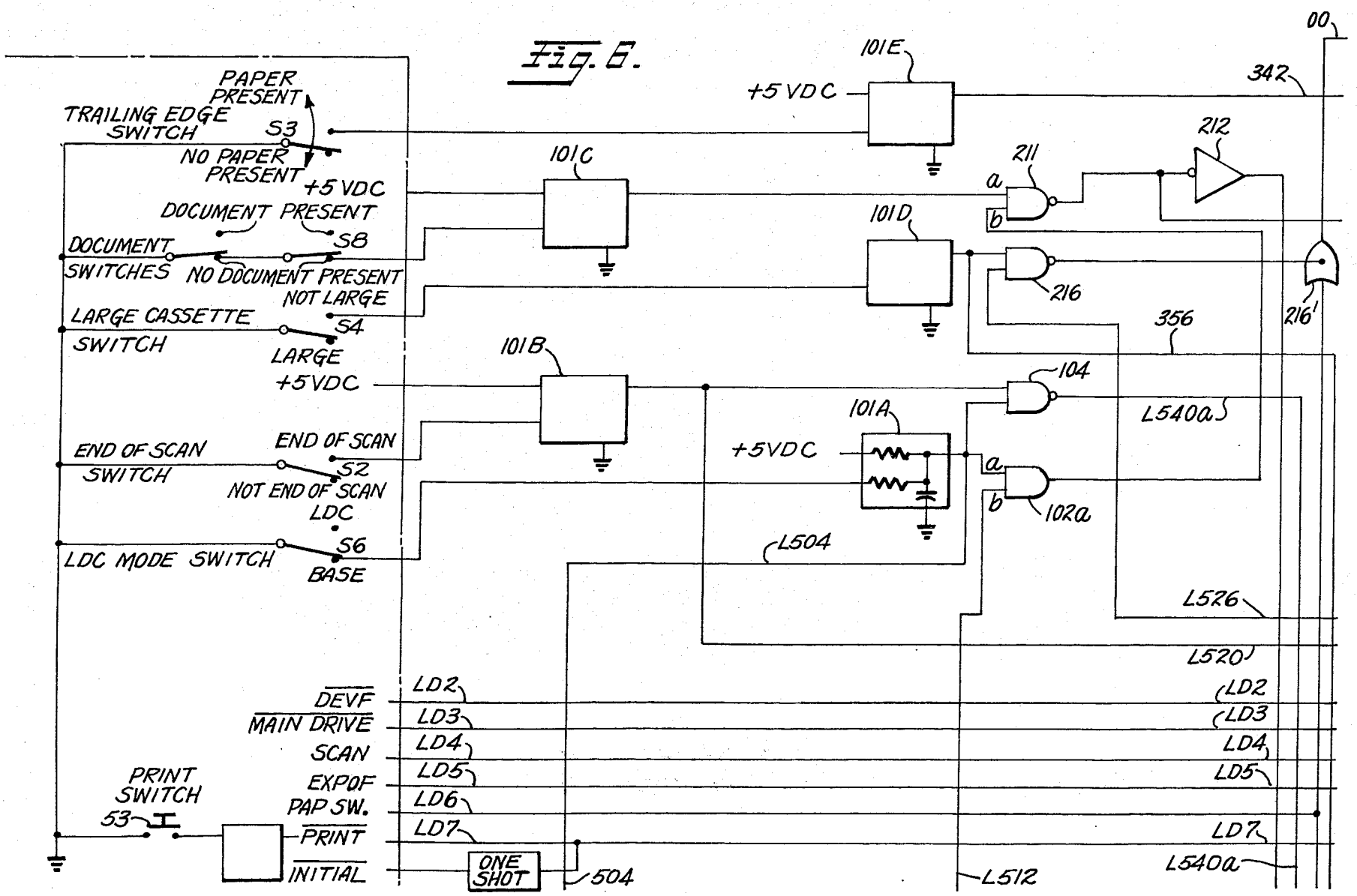
Figure 7:
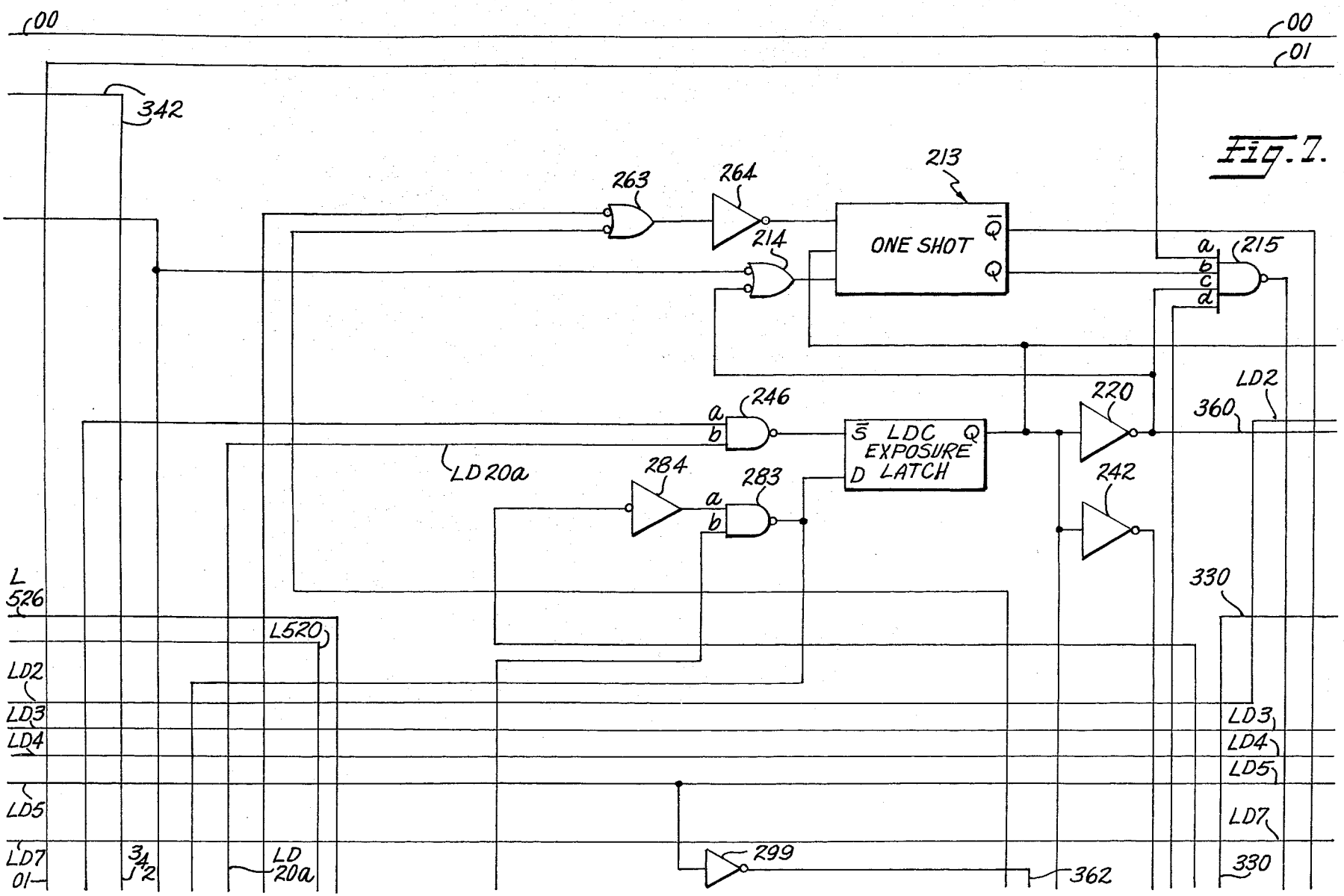
Figure 8:
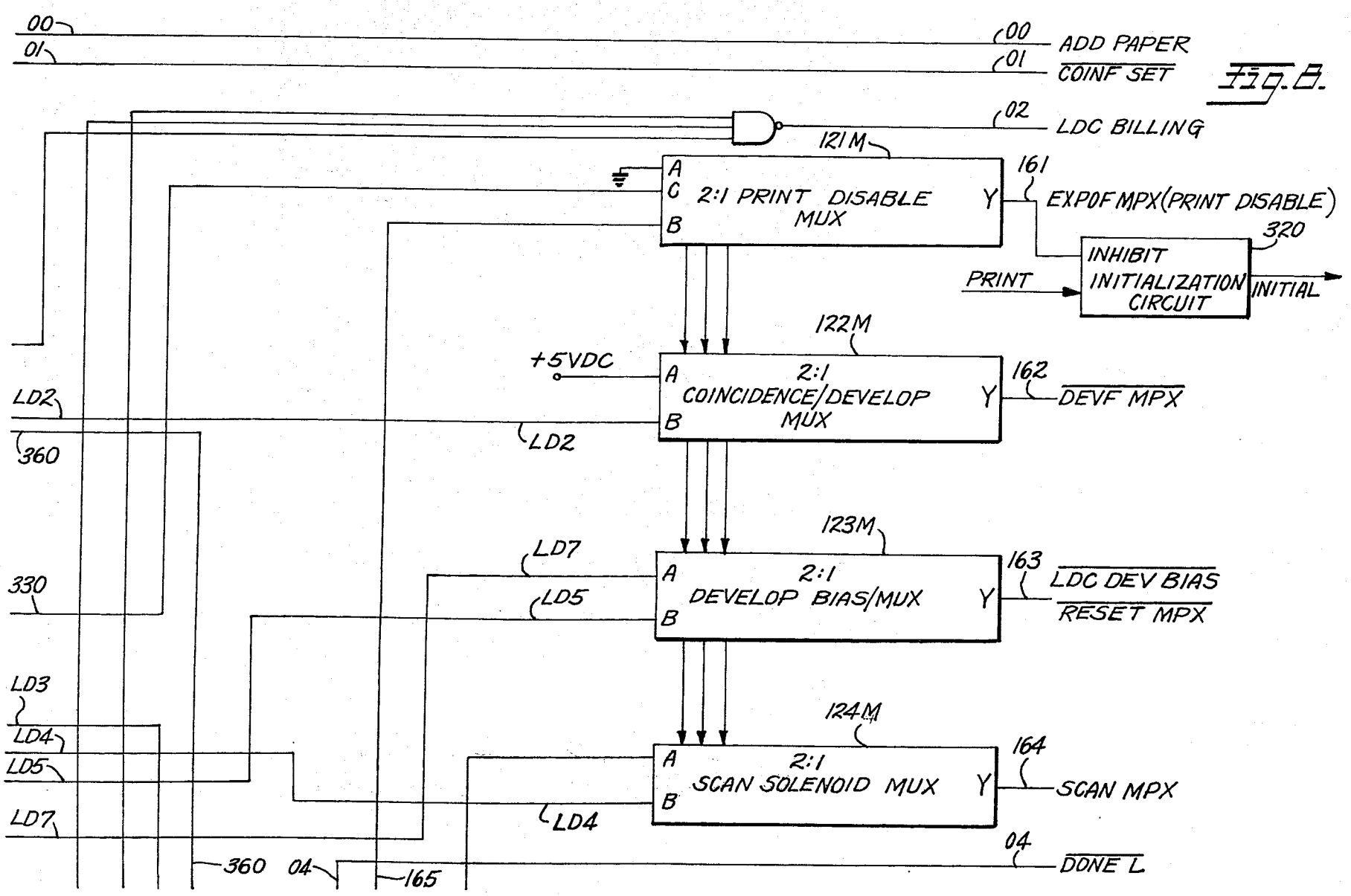
Figure 9:
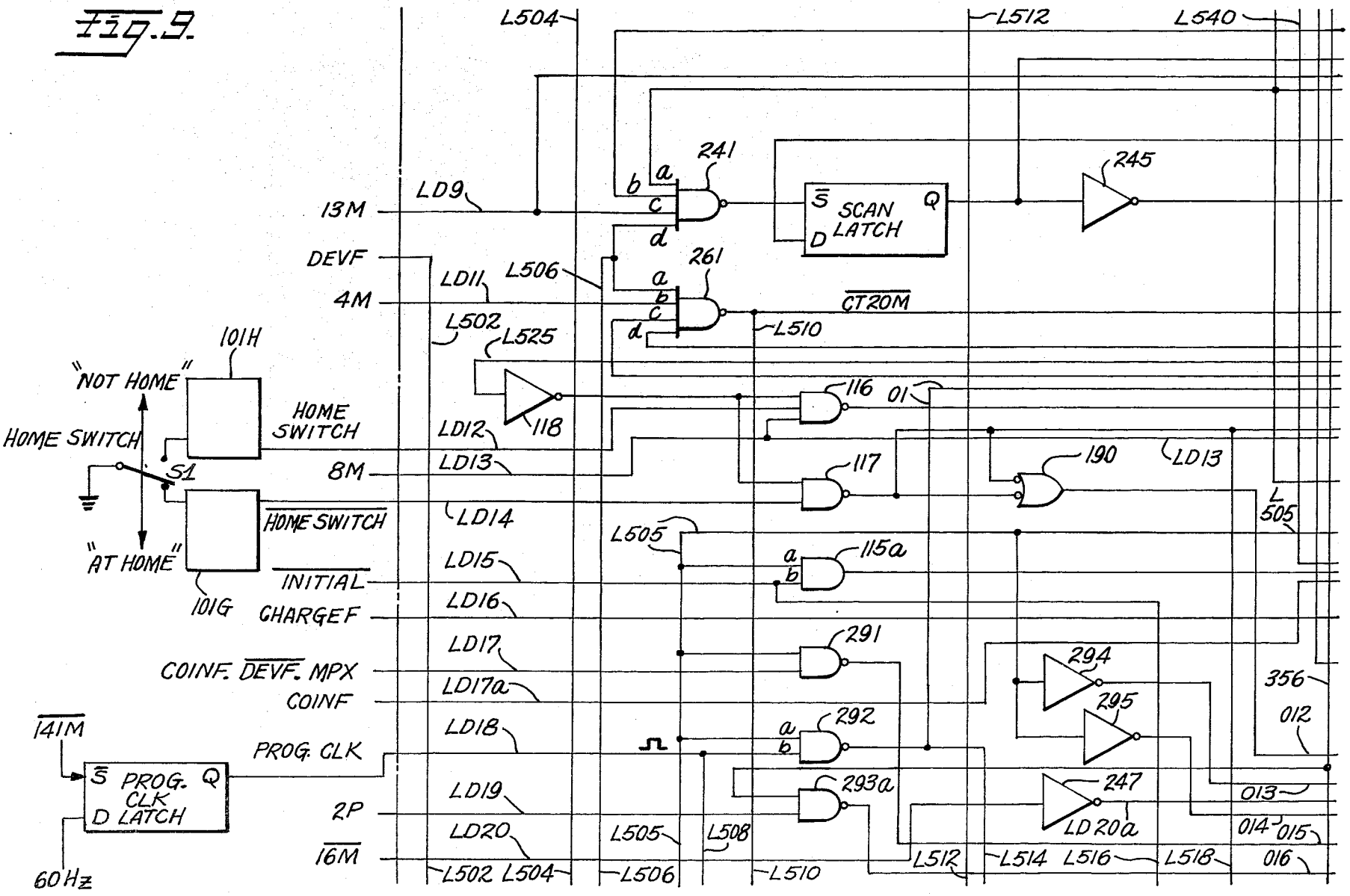
Figure 11:
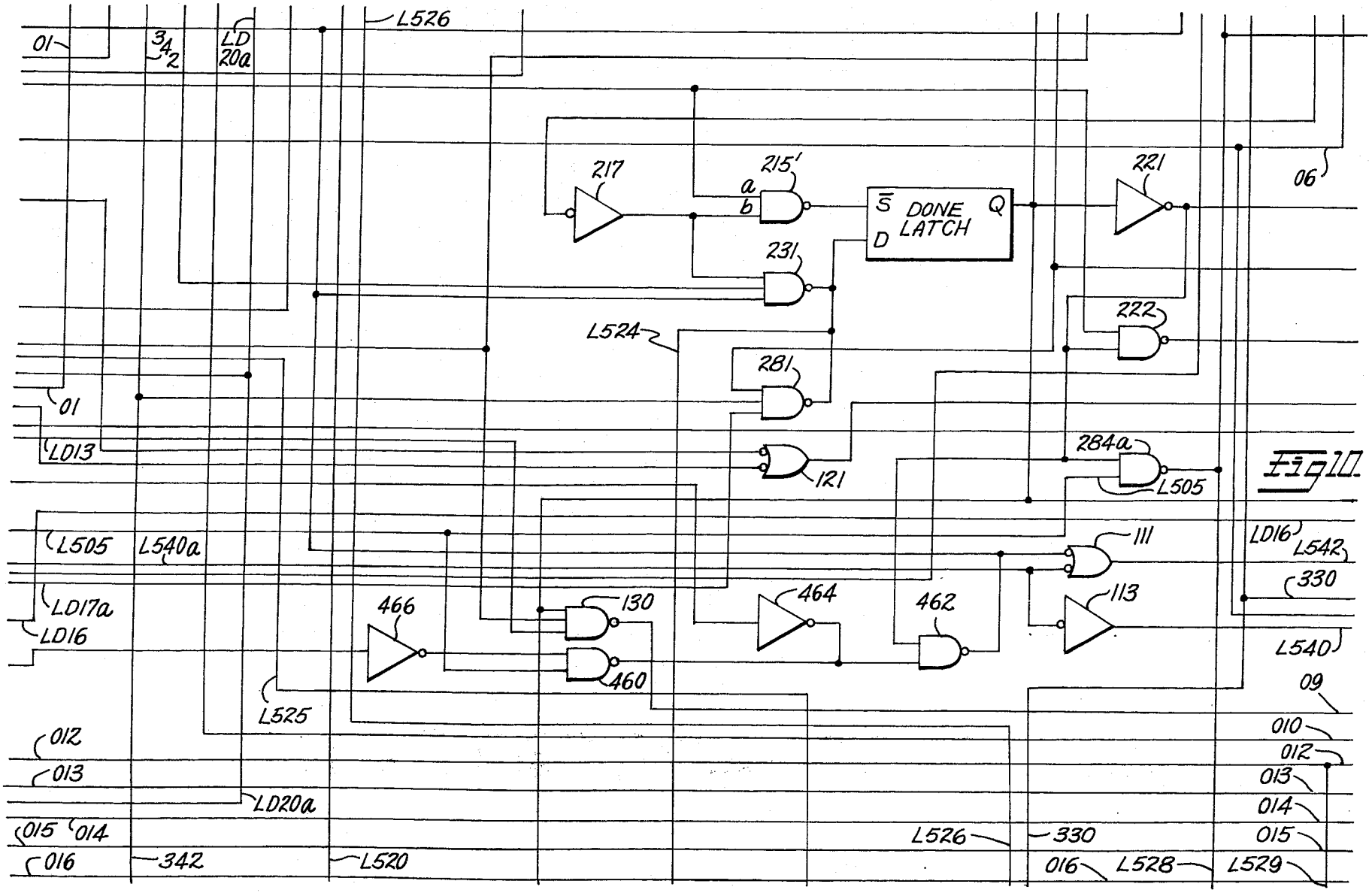
Figure 11:
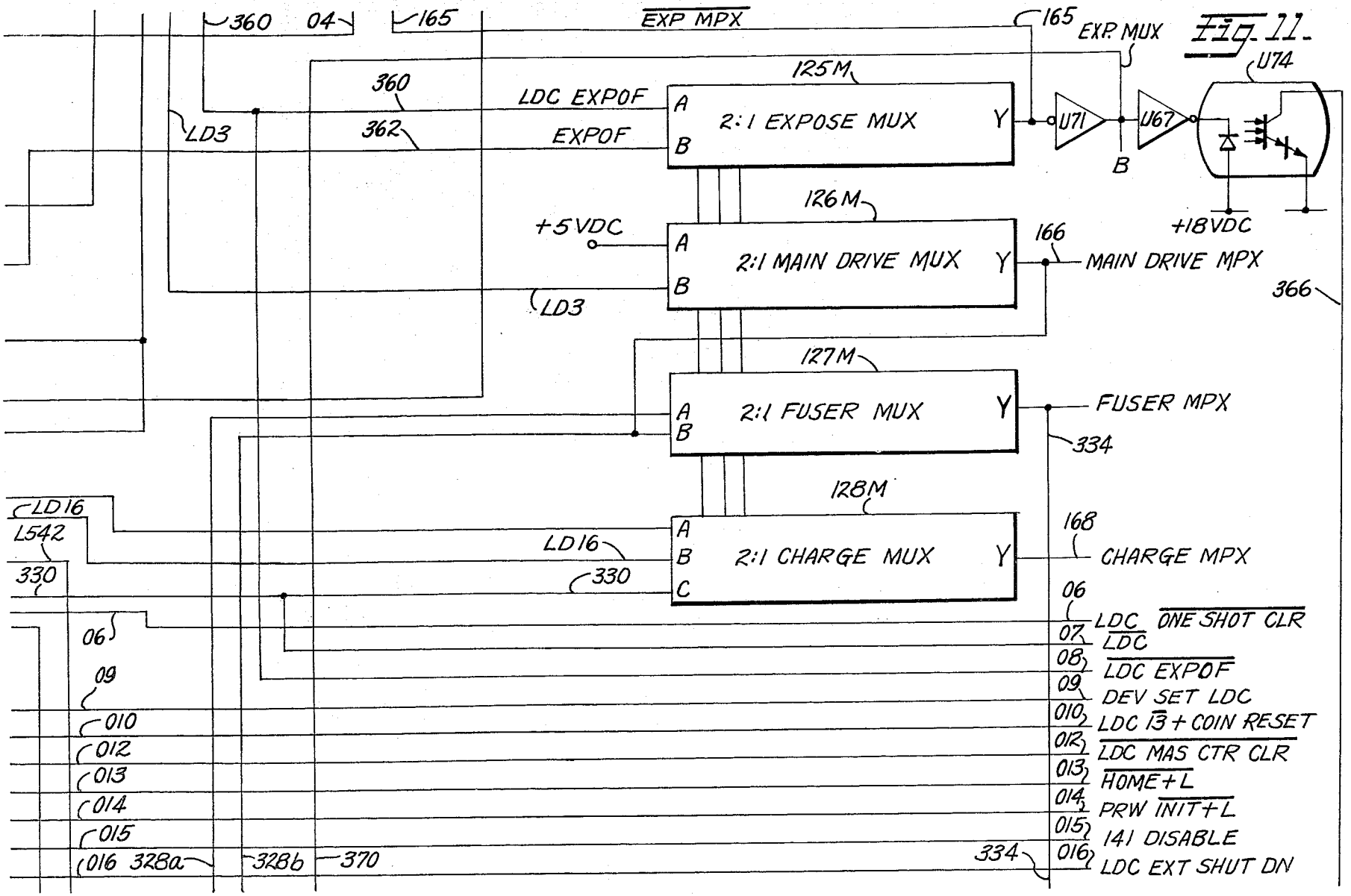
Figure 12:
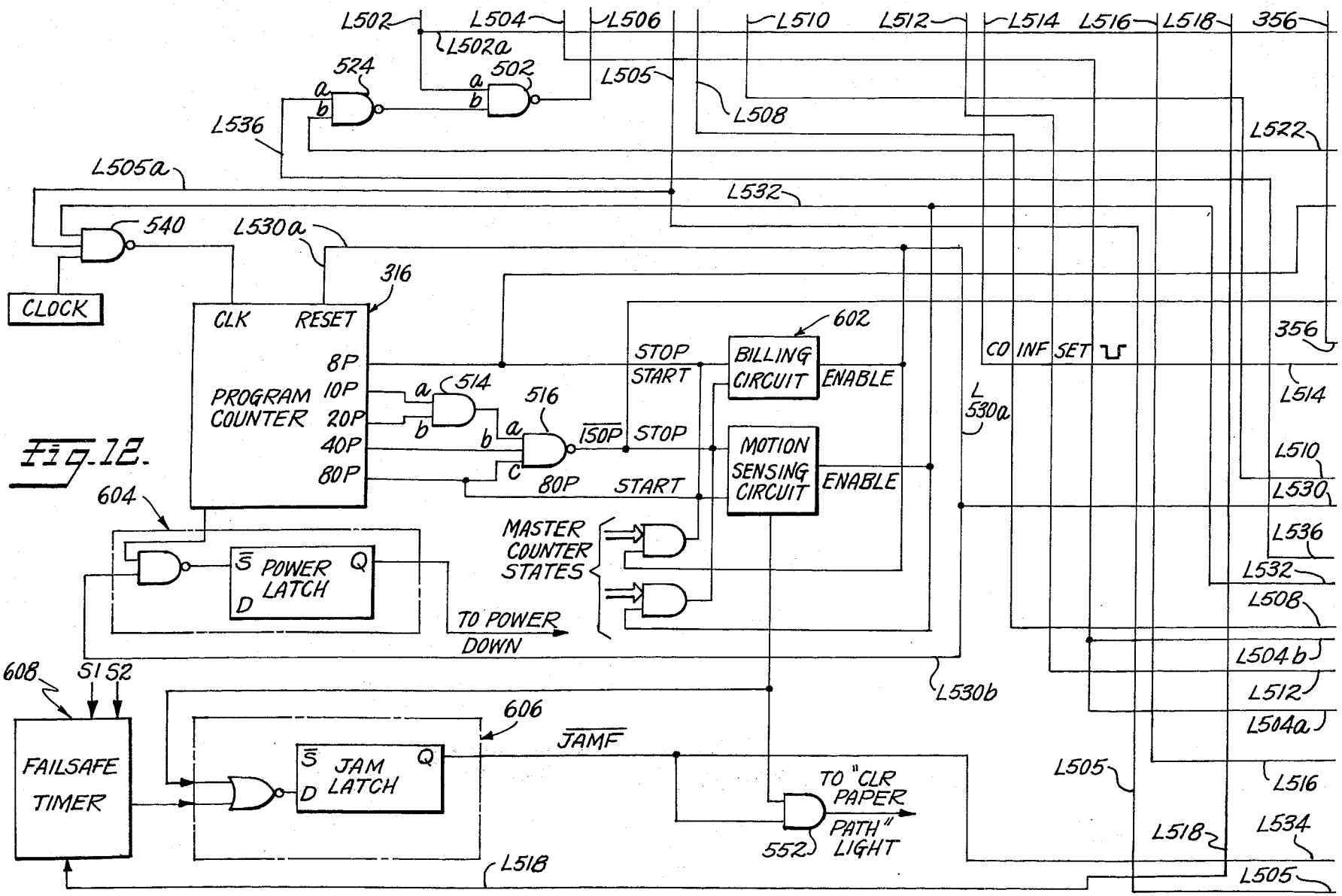
Figure 17:
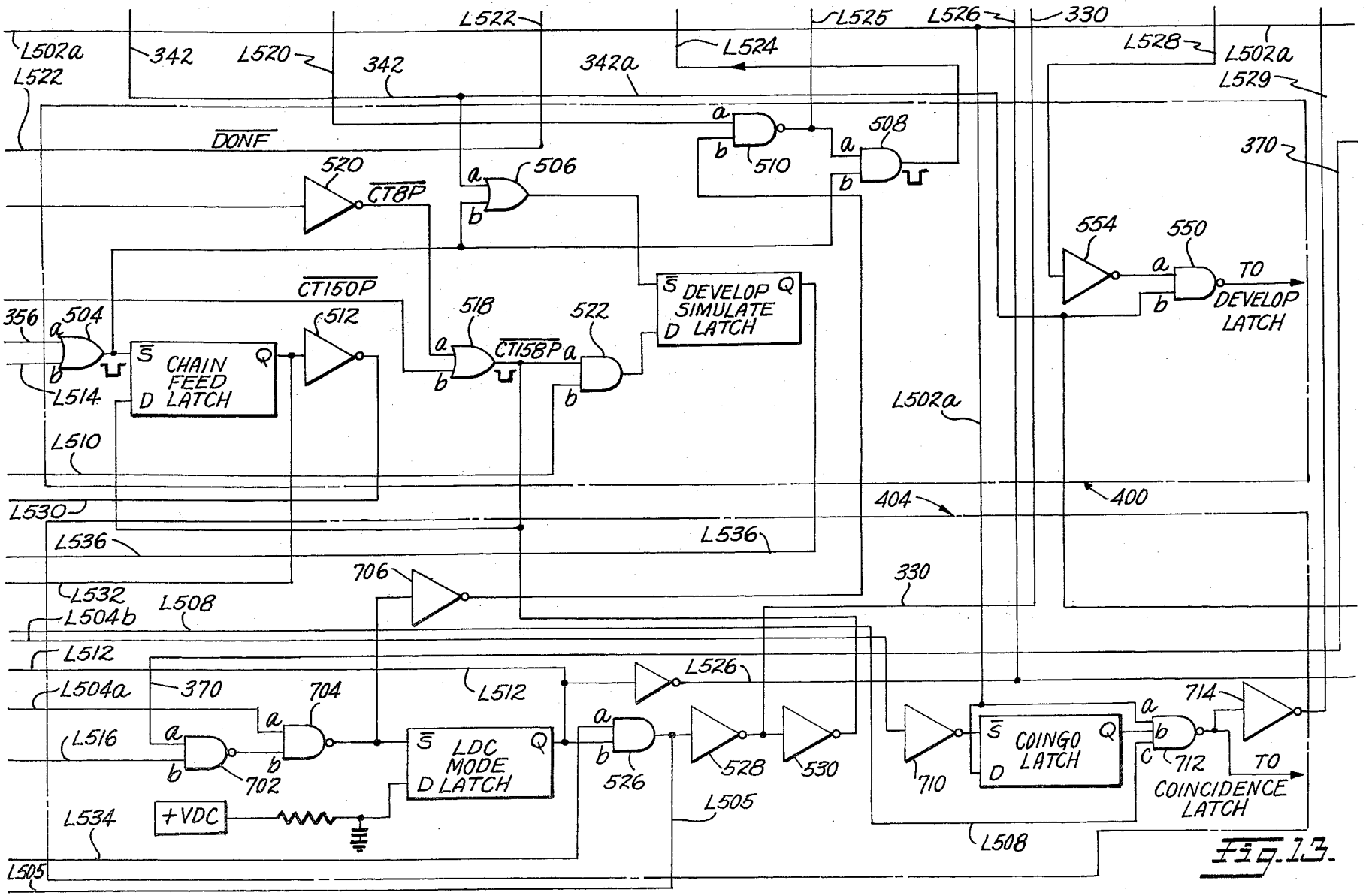
Figure 14:
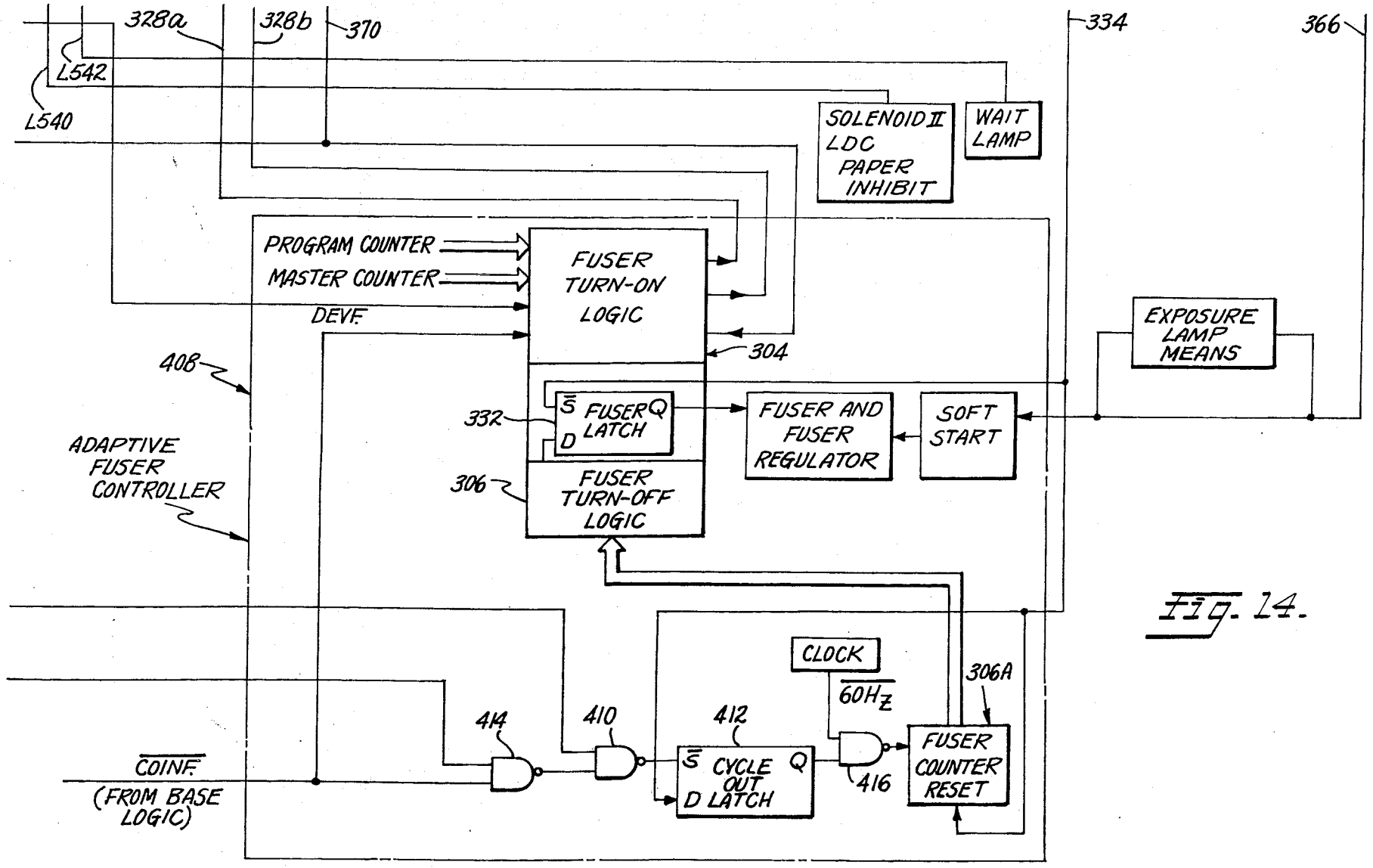

FIGS. 5A and 5B show the LDC/SC timing diagram, and FIGS. 5C and 5D shown a similar diagram for the LDC/LC Mode of operation. By comparing both diagrams, it is seen that for all Large Document Copying Modes of operation, the following events occur: insertion of the document in the document feeding means 30 activates the Document Switches, turns on the charge corotron and resets the Master Counter 318. At CT13M, the Scan Latch is set which effectively means that a copy paper feeding solenoid is energized to initiate the copy paper feeding mechanism. (Scanning of the exposure lamp 21 is not needed in the LDC Mode as the fixed optical system is employed. However, the function of feeding the copy paper is controlled by the Scan Latch). At CT16M, the LDC Exposure Latch is set and the exposure lamp is turned on. At CT20M, the copy paper feed solenoid (via the Scan Latch) is deenergized and the Master Counter is reset. CT8M designates the point at which the Develop Latch is set initiating the development process in the development station. At CT141M-SQ2, the Coincidence Latch is set. The Coincidence Latch is set whenever the numbers of copies exposed is equal to the number of copies ordered by the operator on quantity dial 99. The Coincidence Latch will always be set at CT141M-SQ2 in the LDC Mode as all LDC Modes of operation are single copy modes. The Master Counter is also reset at coincidence. After coincidence, the remaining xerographic processes depend upon whether a small cassette or a large cassette is utilized.

For the LDC/SC Mode (FIGS. 5A and 5B) a second counter means, or Program Counter, is run in parallel with the Master Counter. At CT13M (CT13P), the LDC Exposure Latch is turned off which deactivates the exposure lamp. After CT13P, the states of the Master Counter are not utilized throughout Sequence 3 unless a chain feeding mode of operation is initiated by a subsequent feeding of a document by the document feeding means 30. Assuming no subsequent document is fed, only the Program Counter states are significant after CT13P in Sequence 3. The Development Latch within the BASE LOGIC 300 is turned off slightly before CT72P by the copy paper Trailing Edge Switch. The Trailing Edge Switch also initiates the clocking of still a third counter, the Fuser Counter which is utilized strictly to govern the fuser turn-off time period. At CT72P, the Fuser Counter is reset and full fuser turn-on is achieved. At CT80P, a motion sensing circuit is activated which senses the paper motion of the copy paper in its travel from the transfer station to the fuser station. At CT150P, the motion sensing circuit is deactivated. Between counts 150P and 158P, the billing process is activated and completed. If in fact no subsequent documents were fed into the document feeding means before CT158P, the Master Counter would also be at a state of 158M. In this event, the Master Counter is ready to proceed in controlling the power-down functions of Sequence 4. At CT256M-SQ4, the Program Counter is added in series with the Master Counter to provide a single counter having extended capabilities. (The Master Counter as well as the Program Counter are each eight bit counters). At CT1024 (M + P) the machine is powered down.

In the LDC/LC timing sequence, shown in FIGS. 5C and 5D, the Coincidence Latch also resets the Master Counter at CT141M-SQ2. Here, however, there is no second or Program Counter connected to run in parallel with the Master Counter. Thus, in Sequence 3 the fuser is turned on at CT72M, and the motion sensing circuit is activated during CT84M-CT148M. As different sizes of copy paper may be used in the large cassette in the LDC/LC Mode, the LDC LOGIC 302 interrogates the Trailing Edge Switch at CT157M-SQ3 to see if the original copy paper is still being fed into the machine. If the copy paper has passed by the Trailing Edge Switch, the copy paper would be nominally less than 15 inch long (in the direction of copy paper travel through the machine). The billing functions are then started at CT157M-SQ3 and are complete thirteen (13) Master Counts later provided the original document deactivates the Document Switches. A Done Latch is reset at CT157M-SQ3 which enables the Exposure Latch to turn off the exposure lamp at CT13M after resetting of the Done Latch. The resetting of the Done Latch also serves to turn off the charge corotron and the Develop Latch.

If the copy paper is still present at CT157M-SQ3, (copy paper nominally greater than 15inch), the Master Counter is not set and continues clocking into Sequence 4. The Done Latch is now reset by the Trailing Edge Switch, S3, which is deactivated when the copy paper trailing edge passes thereby. The Trailing Edge Switch also turns on the Fuser Counter. As the exact time at which the Trailing Edge Switch is deactivated depends on the size of copy paper used, an "X" indicates the appropriate Master Counter State as shown in Sequence 4 in FIG. 5C. Again, resetting the Done Latch turns off the Develop Latch and the charge corotron. At "X" + 13M, the LDC Exposure Latch is reset and the exposure lamp turned off. The Fuser is turned off at CT208F, and the Master Counter, extended by the series addition of the Program Counter continues to clock, shutting down power at 1536 (M + P). In the power-down sequence, the Program Counter does nothing more than extend the range of the Master Counter for power-down purposes, and a larger Master Counter would work as well. In this connection, the Master Counter is not "free" to control a subsequently fed document until the end of the billing function whether that be at 157M-SQ3 + 13M or "X" + 13M. A key element in the instant invention is to essentially free the Master Counter at a much earlier time in using the small cassette (FIG. 5A), by employing a second counter, the Program Counter, to control the motion sensing and billing functions. The chain feed control circuit of the instant invention essentially frees the Master Counter after exposure of the first document is complete. The time saved over the conventional LDC/LC Mode of operation is indicated in FIG. 5C with respect to documents less than and greater than 15 inches.

4. Detailed Logic Description

General

A detailed description of the LDC LOGIC 302 of FIGURES 6–11 is found in copending application Ser. No. 528,163, filed Nov. 29, 1974 (D/73383C). The description set forth below emphasizes those features of the multi-mode copier electronics which are particularly germane to the chain feed control circuit (FIGS. 12–13) of the instant invention.

In describing the Chain Feed Logic 400 and the LDC Logic 302, reference is made to the following tables wherein input and output connections are described.

TABLE 2

| INPUTS LINES FROM BASE LOGIC TO LDC LOGIC (See FIGS. 6 and 9) | |
|---|---|
| DEVF [LD2] | This input provides the status of the Develop Latch located in the BASE LOGIC; it exhibits a logical "0" to enable the developing means through multiplexer 122M. |
| MAIN DRIVE [LD3] | This input provides the status of the Main Drive Latch (not shown) in the BASE LOGIC; it exhibits a logical high when the main drive M is not running and logical "0" when it is running. |
| SCAN [LD4] | This input from BASE LOGIC provides a Scan Signal to the Scan Solenoid Mux 124M in the BASE Mode of operation. It is a logical "1" to activate the scanning means in the BASE Mode. |
| EXPOF [LD5] | This input provides the status of the Base Expose Latch located in the BASE LOGIC. It exhibits a |

TABLE 2-continued

| INPUTS LINES FROM BASE LOGIC TO LDC LOGIC (See FIGS. 6 and 9) | |
|---|---|
| | logical "1" when enabling the exposure means. |
| PAPSW [LD6] | This input provides the status of the paper sensing switch. When sufficient copy paper is present it exhibits a logical "1". |
| PRINT [LD7] | This input provides the status of the PRINT Button 53 to the multiplexer 123M. During actuation of the PRINT Button 53, it exhibits a logical "0". |
| CT 13M, 4M, etc. [LD9, LD11] | This input refers to count signals corresponding to 13, 4, etc. of the master counter, provided in the form of a high or logical "1" signal. |
| DEVF [LD10] | This input provides the status of the Develop Latch located in the BASE LOGIC. It is the inverse of $\overline{\text{DEVF}}$ mentioned above; thus when developer C actuating signals are provided by the Development Latch this goes to a logic "1" or high from logical "0". |
| HOME SW [LD12] | This input provides the status of the Home Switch S1. In the actuated state, i.e., when the scanning elements 21–22 are at the home position, it exhibits a logical signal "1". |
| 8M [LD13] | This signal is a binary singal from the Master Counter which is high for eight counts and low for the next eight counts and so forth. It is used to provide a slight delay (8 counts) before actuation of the Scan Latch in mode changing operations. |
| $\overline{\text{HOME SW}}$ [LD14] | This input provides the status of the Home Switch S1. It is the inverse of the above i.e., when the scanning elements 21–22 have left the home position the Home Switch S1 is deactivated thereby providing a logical "1" signal via this line. |
| $\overline{\text{INITIAL}}$ [LD15] | This input provides the initializing signals developed in the BASE LOGIC. When $\overline{\text{INITIAL}}$ level is a logical "0", a power up sequence is occurring and this signal is used to initialize the elements contained in the LDC LOGIC. |
| CHARGEF [LD16] | This input provides the status of the Charge Latch located in the BASE LOGIC. A logical "1" indicates the activation of the charging means E of the xerographic machine. |
| COINF.DEVF. MPX [LD17] | This input provides the composite status of the two named latches. It exhibits a logical "1" when the Coincidence Latch (COINF) is set and the Development Latch is not set. Both latches are located in the BASE LOGIC. |
| COINF SIGNAL [LD17a] | This is the Coincidence Signal from the BASE LOGIC which is high at CT 141M whenever the copier/duplicator is in a single copy run (LDC Modes) or the last copy of a multiple copy run. |
| PROG CLK [LD18] | This input provides a signal associated with the incrementing of the Program Counter. It exhibits a logical "1" when the counter is being incremented; and reverts to a logical "0" upon termination of each incrementing signal. The Program Counter is used to keep track of the number of copies made in a Multiple Copy, BASE Mode run and is incremented at CT141M–SQ2. |

TABLE 3

| OUTPUT LINES FROM LDC LOGIC (See FIGS. 8 and 11) | |
|---|---|
| ADD PAPER [00] | This output is applied to the ADD PAPER indicator to advise as to a copy paper supply run out condition. |
| $\overline{\text{COINF SET}}$ [01] | This output is applied to the Base Logic. It goes to logical "0" setting the Coincidence latch in the Base Logic. |
| LDC BILLING [02] | This output signal is applied to an LDC billing meter, the details of which are shown in the above-mentioned copending application, Serial No. 393,545. |
| EXPOF MPX (PRINT DISABLE) [161] | This output from the multiplexer 121M is used to actuate or energize the exposure means when the document original being scanned must be image exposed on to a photoreceptor. This signal also disable the PRINT button in the BASE Mode operation. |
| $\overline{\text{DEVF-MPX}}$ [162] | This output from the multiplexer 122M controls the developing means. With $\overline{\text{DEVF MPX}}$ of logical "1" the developing means is not on and when it switches to logical "0", the developing means is turned on. |
| $\overline{\text{LDC DEV BIAS RESET MPX}}$ [163] | This output from the multiplexer 123M is applied to the Bias Latch (not shown) of the machine and provides a normal bias level. |

TABLE 3-continued

| OUTPUT LINES FROM LDC LOGIC (See FIGS. 8 and 11) | |
|---|---|
| SCAN MPX [164] | This output from the multiplexer 124M is used to selectively energize the scanning solenoid means in the machine, as well as the copy paper feed solenoid. |
| DONE-L [04] | This output signal signifies that the machine has completed a copy cycle while operating in LDC Mode. It is fed to the Base Exposure Latch in BASE LOGIC 300. |
| EXP MPX [165] | This output signal is applied to the exposure means to selectively maintain it in a non-actuated state. It is also applied to the Base input of multiplexer 121M. |
| MAIN DRIVE MPX [166] | This output from the multiplexer 125M is used to enable the main drive M. |
| FUSER MPX [334] | This output from the multiplexer 127M is applied to the Fuser Latch to selectively energize the fuser element. |
| CHARGE MPX [168] | This output from the multiplexer 128M is applied to the charging means to selectively energize the charge corotron. |
| LDC [07] | This output signifies the operating mode of the machine, it exhibits a logical "0" to denote LDC operation. |
| LDC EXPOF [08] | This output, when a logical "0", resets the BASE mode Exposure Latch which normally controls the jam detection timing. Since the jam detection requirements of the LDC Mode are different from the BASE Mode, the Exposure Latch must be reset. |
| DEV SET LDC [09] | This output, when a logical 0, sets the Developer Latch at the proper time in the LDC Mode, since this time is different than the time required for the BASE Mode. The BASE Mode signal is inhibited by the LDC output which is logical "0" when the machine is in the LDC Mode. |
| LDC 13 + COIN RESET [010] | This output when a logical "0", sets the Coincidence Latch at a count of 13 and Done Latch set signifying that the machine is not processing a piece of copy paper. This output is used to set the Coincidence Latch to logical "1", thereby cycling out the machine if copy is not started. |
| LDC MASTER CTR CLR [012] | This output, when logical "1", signifies that the Master Counter is conditioned to count and when logical "0", the counter is cleared and held at a count of zero. |
| HOME + LDC [013]and PWR INIT +LDC [014] | These signals are actually LDC (the complement of LDC). They perform the function of disabling the HOME Switch LATCH (not shown) while in the LDC Mode and simulating a power initialize pulse when the machine is changed from the BASE Mode to the LDC Mode. |
| 141 DISABLE [015] | This signal, when a logical "0", inhibits the 60Hz clock signal to the Program Counter Latch once coincidence has been set. |
| LDC EXT SHUT DN [016] | This signal, when a logical "0" is used to power-down the machine in the LDC/LC Mode. The output provided represents a timing count in the Master Counter/Program Counter which extends the shutdown time (e.g., 26 seconds) from a shorter shut-down (e.g., 16 seconds) used in the BASE Mode. |
| LDC ONE SHOT CLR [06] | This output, when a logical "0" signifies that the One Shot 213 has been triggered and this causes the resetting of the Master Counter. |

TABLE 4

| SIGNAL EXCHANGE BETWEEN LDC LOGIC AND CHAIN FEED LOGIC | |
|---|---|
| DEVF SIGNAL [L502,L502a L506] | This signal comes from the "Q" node of the Develop Latch in the BASE LOGIC 300 and is used to condition the Scan Latch via NAND gate 502 and line L506 to be actuated only if the development function has terminated e.g., the DEVF signal is low. The signal is also passed along line L502a to reset the Coin Go Latch. |
| LDC MODE SWITCH SIGNAL [L504] | This signal comes from the LDC Mode Switch via the pull-up network 101A. It forms an enable to NAND gate 704 to set the LDC Mode Latch. |
| LDC MODE LATCH . JAMF [L505] | This signal comes from AND gate 526 (FIG. 13) and is high when the LDC Mode Latch is set and no jams exist. |
| PROG CLK | This signal is high, logical "1", for one clock |

TABLE 4-continued

| SIGNAL EXCHANGE BETWEEN LDC LOGIC AND CHAIN FEED LOGIC | |
|---|---|
| SIGNAL [L508] | pulse whenever there is a coincidence i.e. the Program Counter keeps track of the number of copies made in the BASE Mode multiple copy runs and is incremented once for all LDC Mode operations at CT141M. It is used to force coincidence in changing modes from BASE, multiple copy runs to LDC Mode. |
| CT20M [L510] | This signal is a low pulse at CT20M and is used to reset the Develop Simulate Latch. |
| LDC MODE LATCH [L512] | This signal is high whenever the LDC Mode Latch is set. |
| COINF SET [LD18,L514] | In the LDC/SC Mode, this signal is fed to OR gate 504 to provide a negative going pulse at coincidence (CT141M-SQ2) which is used in connection with the resetting of the Done Latch and the setting of the Develop Simulate Latch. |
| INITIAL [LD15,L516] | This signal is fed to NAND gate 702 in the Cycle-Out Logic 404 to condition the LDC Mode Latch. |
| FAILSAFE TIMER [L518] | This signal initiates the failsafe timer which times the scanning of the optical carriage from the Home Position to the End of Scan Position. |
| LARGE CASSETTE SWITCH SIGNAL [356] | This signal comes from the Large Cassette Switch via pull-up network 101D. It is used to inhibit the setting of the Chain Feed Latch in Large Cassette modes. |
| TRAILING EDGE SWITCH SIGNAL [342,342a] | This signal is fed to OR gate 506 to condition the Develop Simulate Latch, and to NAND gate 550 to condition the Develop Latch. |
| END OF SCAN SIGNAL [L520] | This signal is low when the scanning carriage is at the End of Scan (EOS) Position and forces the resetting of the Done Latch until carriage reaches EOS. |
| DONEF SIGNAL [L522] | This signal is fed to NAND gate 524 to allow actuation of the Scan Latch for a second copy before completion of the development process of a first copy in a Chain Feed Mode of operation. |
| DONE RESET [L524] | This signal is used to reset the Done Latch at Coincidence in the LDC/SC mode of operation. |
| EOS . LDC MODE [L525] | This signal is fed to inverting gate 118 and is low whenever the carriage is at the EOS position and the LDC Mode Latch is set. |
| LDC MODE LATCH SIGNAL [L526] | This signal is low whenever the LDC Mode Latch is set. It is fed to NAND gate 216. |
| LDC MODE LATCH . JAMF SIGNAL [330] | This signal is low whenever the LDC Mode Latch is set and no jams are present. It is fed to the "select" or "C" terminals of the multiplexers 121M-128M. |
| DONE . LDC MODE [L528] | This signal is used to reset the Develop Latch when the Done Latch is reset in the LDC Mode via NAND gate 550. |
| LDC MAS CTR CLR SIGNAL [L529, 012] | This signal originates from NAND gate 712 when the Coin Go Latch of the Cycle-Out Logic 404 is set to force a coincidence and reset the Master Counter in mode changing operations. |
| PAPER FEED INHIBIT SIGNAL [L540] | This signal is used to inhibit the feeding of copy paper when the scanning carriage is not in the End of Scan position, and the LDC Mode Latch is set. |
| WAIT SIGNAL [L542] | This signal is used to energize the "wait" visual indication means 50 when the Done Latch is set or when the machine is in the LDC Mode but the scanning carriage is not at the End of Scan position. It is also energized when the paper supply is depleted. |
| FUSER SIGNALS [L328a, L328b, 370 | These signals connect the Fuser Turn-On Logic Circuit 304 of the Adaptive Fuser Controller to the Fuser and Exposure multiplexers. |

In the LDC LOGIC 302 shown in FIGS. 6–11, the gate and circuit designates remain the same as those in the above mentioned copending application. Several simplifications have been made to the drawing, however for ease of understanding the instant chain feed logic circuit. In particular, only pull-up circuit 101A has been shown in detail although all such circuits 101A, B, C, etc., are identical. In addition, the multiplexers have been indicated in block form only as they are all identical to the multiplexer shown in detail in FIG. 16A. Finally, the latches are shown in block form and are all identical to the latch shown in detail in FIG. 16D. The latches are operated in the R/S (reset/set) mode, and for simplicity, the memory reset signal (MR) has not been drawn. The memory reset signal is supplied by the Initialization Circuit 320 in a conventional manner.

In general, key xerographic functions are controlled by actuating signals fed through the 2:1 multiplexers 121M–128M. The multiplexers are conditioned to pass through the logical equivalent of a selected input signal at terminal A or B depending upon whether the copier is in the LDC Mode or BASE Mode respectively. The C or "select" terminal (shown on multiplexers 121M and 128M) serve to select which input signal is fed to the multiplexer output. The signal feeding the select terminal comes from the LDC Mode Latch (FIG. 13) via NAND gate 526, inverting gate 528 and line 330. A high signal, logical 1, indicates the BASE Mode and a low signal, logical 0, indicates the LDC Mode. In incorporating the instant invention into the LDC LOGIC 302, a key difference in the instant circuit over that of the aforementioned copending application involves replacing the dependency of most logic components, particularly the multiplexers, from the LDC Mode Switch, S6, to the LDC Mode Latch. Other features of the LDC LOGIC 302 (FIGS. 6–11) will become clear in connection with the description of the chain feed control circuit described below.

The description assumes that the copier/duplicator is already in the LDC Mode of operation (the LDC Mode Latch is set), and the logic circuits have been initialized (via Initialization Circuit 320) either by depressing the Pring Button 53 (if the machine was in standby and had cycle-out) or the actuation of the lever 31 in placing the copier/duplicator in the LDC Mode from the BASE Mode. The latches are all reset by the Initialization Circuit during Sequence 1. Further, the small cassette is inserted for use in the LDC/SC mode or chain-feeding mode of operation.

LDC/SC Mode

To start the xerographic processes, the operator places a document into the document feeding means 30. The actuation of the Document Switches S7 and/or S8 serve to reset the Master Counter 318, set the Done Latch, turn on the charge corotron and start Sequence 2 which begins key xerographic functions. The Master Counter is reset by the low $\overline{\text{LDC ONE SHOT CLR}}$ signal along line 06 from the $\overline{Q}$ node of One Shot 213 (FIG. 7). The Document Switch S7 and/or S8 trigger One Shot 213 via NAND gate 211 and NOR gate 214. More specifically, in response to the actuation of the Document Switches, pull-up network 101C exhibits a logical 1 state which is fed to the *a* input of NAND gate 211. The *b* input of NAND gate 211 comes from the output of AND gate 102a which is also a logical 1 as both of its inputs are high; namely, the *a* input of AND gate 102*a* is high as the LDC Mode Switch is actuated to the LDC Mode position, and the *b* input of AND gate 102*a* is high (via line L512) as the LDC Mode Latch is set (Q output high). Thus, the output of NAND gate 211 is low upon the feeding in of a document original and the low signal drives the output of NOR gate 214 high firing One Shot 213.

The Q output of One Shot 213, a high output signal, is fed to the *b* input of NAND gate 215. The *a* input of NAND gate 215 is a high signal coming from NAND gate 216 via pull-up network 101D and the Large Cassette Switch set in the "not large" position i.e. small cassette. The *c* input of NAND gate 215 is a high signal from an inverting gate 220 fed by the LDC Exposure Latch. (The Q node of the LDC Exposure Latch is low as exposure is not yet taking place). The *d* input to NAND gate 215 is also a high signal coming from AND gate 115a (FIG. 9), which has both of its inputs high. The *a* input of AND gate 115*a* comes from AND gate 526 (FIG. 13) which is high whenever the LDC Mode Latch is set and no paper jams have occurred. The *b* input of AND gate 115*a* is supplied by the $\overline{\text{INITIAL}}$ Signal from the BASE LOGIC 300 via line LD15 and is high whenever one is not initializing i.e. not in Sequence 1.

Thus, all inputs to NAND gate 215 are high when the One Shot 213 is fired upon actuation of the Document Switches. The low output of NAND gate 215 is inverted by inverting gate 217 and a high signal is fed to the *b* input of NAND gate 215 (FIG. 10). The *a* input to NAND gate 215 is also high as it is fed by inverting gate 212 (FIG. 6). The two highs cause the output of NAND gate 215 to go low thereby setting the Done Latch. The "Q" node of the Done Latch is directly connected to the "A" terminal of Charge Mux 128M, and the high signal from the Done Latch is passed through the Charge Mux to initiate the corotron charge. Note that all of the multiplexers 121M–128M are conditioned by the LDC Mode Latch (via line 330, inverting gate 528 and NAND gate 526) to select their "A" terminal inputs and essentially pass these signals through to the multiplexer output terminals "Y".

After the charge corotron is turned on at CTOM-SQ2, the next event to occur is the copy paper feeding which is controlled by the Scan Latch. At CT13M-SQ2, the Scan Latch (FIG. 9) is set so that its "Q" output is high (logical 1). The setting of the Scan Latch at CT13M-SQ2, is conditioned by all of the inputs to NAND gate 241 being high. Input *a* of NAND gate 241 comes from the Document Switches S7 and S8 via NAND gate 211 and inverter 212. Thus, since the Document Switches are actuated, a high signal is fed to input *a* of NAND gate 211. In addition, the *b* input of NAND gate 211 is high via AND gate 102a because the LDC Mode Latch (FIG. 13) is set and the LDC Mode Switch Signal is high. The two high inputs to NAND gate 211 causes its output to go low, and the low signal is inverted to feed the *a* input of NAND gate 241. The *b* input of NAND gate 241 is an inverted (inverting gate 242) LDC Expose Latch signal ($\overline{\text{LDC EXP}}$) and thus is high as exposure is not yet in process. The "c" input of NAND gate 241 is high only at CT13M from the Master Counter. The *d* input of NAND gate 241 is essentially the DEVF signal which comes from the Develop Latch (in BASE LOGIC 300). However, the DEVF signal is first fed to the *a* input of NAND gate 502 via a line L502 (FIG. 12). Logically, the output of NAND gate 502 is high if either of its inputs are low. As at CT13M-SQ2, the DEVF signal is low, (no development) thus a high signal is fed to input *d* of NAND gate 241 via line L506. As all inputs of NAND gate 241 are high at CT13M, the Scan Latch is set, forcing its "Q" output high. The high signal is inverted by inverting gate 245 and fed to NOR gate 121 (FIG. 10) where a high signal is fed to the Scan Solenoid Multiplexer 124M.

The Scan Solenoid Multiplexer 124M is conditioned to select the A terminal signals via lines 330 as the LDC Mode Latch is set. Thus, in the LDC Mode, the high signal is fed through multiplexer 124M and serves to feed in copy paper as the optical system is fixed and scanning takes place with the movement of the document by the document feeding means 30. It is thus understood that if the copier/duplicator is in the LDC Mode with the optical carriage at the End of Scan position, the setting of the Scan Latch will serve to feed in copy paper. Note that in the Base Mode, the setting of the Scan Latch serves both to feed in copy paper and start the optical carriage moving from the Home position to the End of Scan position.

The next event of interest occurs at CT16M. A CT16M signal is fed to the *b* input of NAND gate 246 (FIG. 7) via line LD20*a*, inverting gate 247 and line LD20. As the *a* input of NAND gate 246 has been set high by the Scan Latch at CT13M, the occurrence of the CT16M signal at the input of NAND gate 246 causes its output to go low thereby setting the LDC Expose Latch ("Q" output high). The "Q" output of the LDC Exposure Latch is routed by Expose Mux 125M to energize the Exposure Lamp in the copier/duplicator.

A further connection from the "Q" output of LDC Exposure Latch is applied to a *d* input of a NAND gate 261 (FIG. 9). At a *b* and *c* input of NAND gate 261 are provided respectively a master count state of 4 via a line LD11 and 16 from the output of inverting gate 247. The *a* input to NAND gate 261 is fed by the high $\overline{\text{DEVF}}$ signal via NAND gate 502. The output of NAND gate 261 will therefore transition to a low logic level at CT20M. This transition effectively resets the Scan Latch via NOR gate 263 (FIG. 7), inverting gate 264, and the $\overline{Q}$ output terminal (low signal) of One Shot 213. The resetting of the Scan Latch effectively deactivates the paper feed solenoid and, the paper feed mechanism is now automatically continued throughout the cycle. An additional $\overline{Q}$ output of One Shot 213 is applied to reset the Master Counter, via the LDC $\overline{\text{ONE SHOT CLR}}$ Signal on line 06 (FIG. 11).

On reaching CT8M after reset of the Master Counter, the Develop Latch in the BASE LOGIC 300 is set to its high state thereby initiating the development process. The Develop Latch is set by NAND gate 130 (FIG. 10) and line 90 which carries the DEV SET LDC Signal to feed the S node of the Develop Latch. It is noted that NAND gate 130 is low only if the Done Latch is set (logical 1), the LDC Exposure Latch is set and CT8M is high. These logic requirements actuate the Develop Latch in the LDC Mode at CT8M after start of exposure in Sequence 2.

At CT141M-SQ2, the Program Clock Latch (BASE LOGIC) is set to its high state for one clock period as its "D" node is tied to a clock source (60 Hz as is the Master Counter). The positive pulse from the Program Clock Latch is applied via line LD18 to the *b* input of NAND gate 292. An *a* input of NAND gate 292 is provided with a LDC Mode Latch. $\overline{\text{JAMF}}$ signal via line L505, AND gate 526 and the LDC Mode Latch. This signal is high for all times when the machine is operating in the LDC Mode (and no malfunctions occur). The output of NAND gate 292, the COINF SET signal is therefore a single low pulse, logical 0, which is applied via output line 01 to set the Coincidence Latch at CT141M in the BASE LOGIC. The Coincidence signal denotes the condition wherein no further copies are to be made as indicated by the number of copies ordered by the operator on dial 99. In all LDC Modes of operation only single copy runs are permitted as all documents must physically be relocated within the feeding means 30. Multiple copy runs are permitted in the BASE Mode of operation wherein the scanning elements 21 & 22 go through the ordered number of complete cycles before the coincidence signal is generated. Thus the Coincidence Latch is set at CT141M in all LDC Modes of operation and in the last copy of a multiple copy BASE Mode of operation.

The $\overline{\text{COINF SET}}$ signal is also applied via a line L514 to the *b* input of an OR gate 504 (FIG. 13). A large cassette switch S4, in "not large" condition supplies a low logic level via pull-up network 101D and line 356 to the *a* input of OR gate 504. The output of OR gate 504, will therefore transition to a low logic level for the duration of the $\overline{\text{COINF SET}}$ signal applied to its *b* input and in turn will apply this low logic level to the $\overline{S}$ input of a Chain Feed Latch. As a consequence, the Chain Feed Latch is set ($\overline{Q}$ output high). A further output from OR gate 504 is applied to the *b* input of OR gate 506, whose output is applied to the $\overline{S}$ input of the Develop Simulate Latch. The output of the Trailing Edge Switch S3, in the "paper present" position provides a low logic level via pull-up network 101E and a line 342 to an *a* input of OR gate 506. Thus an occurrence of the $\overline{\text{COINF SET}}$ signal, OR gate 506 will set the Develop Simulate Latch to the high state also.

A further output from OR gate 504 is applied to the *b* input of a AND gate 508. An End of Scan Switch S2 applies a low logic signal via pull-up network 101B and a line L520 to an *a* input of a NAND gate 510. The output of NAND gate 510, a high logic level, is applied to an *a* input of AND gate 508, whose output then becomes a low logic level for the duration of the $\overline{\text{COINF SET}}$ signal. The output of AND gate 508 is applied via a line L524 to the D input of the DONE Latch, thereby resetting the latch to the low logic level. Resetting the DONE Latch causes the charge corotron to be turned off via Change Mux 128M.

The "Q" output of the Chain Feed Latch is applied via an inverting gate 512 and lines L530 and L530*a* to provide a low logic level for removing the normally high resetting signal to the Program Counter 316 (FIG. 12) located in Chain Feed Logic 400. A further output via inverting gate 512 and lines L530 and L530*a* is applied to Billing Logic 602 thereby enabling billing in response to Program Counter States in Sequence 3. A final inverted output of the Chain Feed Latch is fed via lines L530 and L530*b* to inhibit the Power Latch in the Power Down Circuit 604. This is done as it it is not desired to power down the machine while using the Program Counter in the Chain Feeding Mode.

As the Program Counter has been reset, it is necessary to start the Program Counter running so that it clocks in parallel with the Master Counter. To allow clocking of the Program Counter, a high logic signal is fed from the "Q" node of the Chain Feed Latch via line L532 to one input of NAND gate 540. A second and third input to NAND gate 540 are respectively clock signals (60Hz) and an LDC Mode Latch Signal via line L505 and L505*a*. The Motion Sensing Circuit 600 is also enabled by the Chain Feed Latch so that it is operative in Sequence 3. Thus as long as one is in the LDC/SC Mode, the Chain Feed Latch resets and starts the Program Counter at CT141-SQ2 and enables motion sensing functions (for paper jam detection) and billing.

At CT13M-SQ3, exposure goes off. A CT13M signal via line LD9 is applied to a *b* input of NAND gate 283 (FIG. 7). An *a* input to NAND gate 283 is held at the high logic level via an inverting gate 284, reflecting the general condition that the machine is operating in the LDC Mode and the DONE Latch is reset (e.g. NAND gate 284*a*). Therefore on the occurrence of CT13M-SQ3 the output of NAND gate 283 transitions to the low level causing the LDC Exposure Latch to be reset, thereby extinguishing the exposed lamp in the copier/duplicator. It is important to note that the copier/duplicator machine can now be ordered to begin making a subsequent copy merely by the operator inserting a new document original into the document feeding means 30. Inserting the second or subsequent document at CT13M-SQ3 functional means that one is exposing a second document immediately after completion of exposure of the first document. This is conceptually the earliest time at which a subsequent document could be exposed when utilizing a single document exposure optical system. Thus the chain feeding mode of operation of the instant invention allows a much faster chain feeding process. In implementing this fast chain feeding, the Program Counter is utilized to control and track the copy paper being processed after CT13M-SQ3. The Master Counter is essentially free at this point to control and track a subsequent copy paper associated with a subsequently fed original. For ease of description the Program Counter states in Sequence 3 are discussed below disregarding any resettings and clockings of the Master Counter which would occur simultaneously if a subsequent document was fed into the machine after CT13M-SQ3.

Program Counter — Sequence 3

Because of the paper speed through the copier/duplicator and the machine geometry, the next event to occur in the LDC/SC Mode is the actuation of the Trailing Edge Switch S3. For copy paper of nominally 8½ inches (by 11 inches) the Trailing Edge Switch is actuated at a time slightly before the Program Counter has accumulated seventy-two counts (72P). On actuation of the Trailing Edge Switch, the Develop Latch is reset thereby ending the Develop Process. To reset the Develop Latch in BASE LOGIC 300, a Trailing Edge Switch Signal is fed to the *b* input of NAND gate 550 (FIG. 13) via lines 342 and 342*a*. The *a* input of NAND gate 550 is fed by a $\overline{\text{DONE}}$. LDC Mode Latch Signal (Done Latch reset to low state, and machine in LDC Mode) via NAND gate 284*a*, line L528 and inverting gate 554. Thus, the Trailing Edge Switch will always turn off the Develop Latch in the LDC Mode, after the Done Latch is reset. The Trailing Edge Switch Signal also starts the Fuser Counter as this signal sets the Cycle Out Latch 412 (FIG. 14) via NAND gate 410. Both the Cycle Out Latch 412 and NAND gate 410 are part of the Adaptive Fuser Controller 408.

The next event to occur is full fuser turn-on at CT72P. At this time the Fuser Counter 306A is reset by Fuser Turn-On Logic 304 and begins to accumulate counts at the input clock rate (60 Hz). Full details of the Fuser operation are contained in a concurrently filed application assigned to the same assignee as the instant invention and entitled "Adaptive Fuser Controller" by Thomas J. Mooney. It is noted, that beyond the count of 72P, all three counters of the copier/duplicator are now running. The Fuser Counter, reset at the count of 72P, runs until it accumulates 184 counts (184F) at which time it turns off the fuser. The Master Counter, although running is parallel with the Program Counter, is performing no function unless a chain feed cycle has been entered. The Program Counter continues to run controlling the remaining functions, associated with completing the copy in process, namely, motion sensing and billing.

Between the counts of 80P and 150P a Motion Sensing Circuit 600 located in the BASE LOGIC 300 senses for paper jams as the copy paper progresses from the transfer station to the fusing station. Between the counts of 150P and 158P the billing functions are performed, which provide an indication of the number of copies made on the machine. At the count of 158P, Sequence 3 ends and the Copier/duplicator enters its power-down cycle, Sequence 5. Details of the billing and Motion Sensing (jam detection) circuits are well known as illustrated for example by the Fantozzi U.S. Pat. No. 3,813,157.

It is noted that the Billing Circuit 602 and Motion Sensing Circuit 602 (copy paper motion) are of known design and commonly used in xerographic machines having, for example, only a BASE Mode of operation. In effect, instead of having the Master Counter states control the activation and deactivation of the appropriate logic, (as is done in BASE Mode and LDC/LC Mode) the Program Counter states are so connected. The importance of having the Program Counter control the billing and motion processes is to free the Master Counter for use in governing the timing of xerographic processes for a subsequently fed document when utilizing the chain feeding mode.

In order to feed the activating and deactivating Program Counter states to the Motion Sensing and Billing Circuits, appropriate decode gates are provided as shown in FIG. 12. Five states of the Program Counter 316, states 8P, 10P, 20P, 40P and 80P are supplied. Counter states 10P and 20P are applied to the *a* and *b* inputs respectively of an AND gate 514, whose output is applied to an *a* input of a NAND gate 516. Further, count 40P and count 80P are applied to the *b* and *c* inputs respectively of NAND gate 516. The output of NAND gate 516 therefore exhibits a negative going transition upon the accumulation of one hundred and fifty counts of the Program Counter (150P). This signal, $\overline{\text{CT150P}}$ is applied to deactivate the Motion Sensing Circuit 600 and to activate the Billing Logic 602. Prior to this signal a CT80P signal is fed to activate the Motion Sensing Logic. To deactivate the Billing Logic 602 at CT158P, an 8P signal is fed to the Billing Logic 602 so that billing is terminated 8 Program Counter states after 150P.

As the Program Counter is used to serially augment the Master Counter during the power-down process of Sequence 4, all Program Counter states must be ignored by the Billing Logic and Motion Sensing Logic unless they occur in Sequence 3. The "enable" lines thus serve to enable billing and jam detection only in Sequence 3, e.g., when the Chain Feed Latch is set. Thus, to reset the Chain Feed Latch at CT158P, the $\overline{\text{CT150P}}$ signal is further applied to a *b* input of OR gate 518 (FIG. 13). The *a* input of OR gate 518 is a $\overline{\text{CT8P}}$ signal from the Program Counter via inverting gate 520. Thus, at $\overline{\text{CT158P}}$ the output of OR gate 518 produces a low logic pulse which is applied to the "D"

input of the Chain Feed Latch. The negative logic level at the "D" input of the Chain Feed Latch unconditionally resets the latch to the low state. The resetting of the Chain Feed Latch inhibits further independent counting by the Program Counter and inhibits further operation of the billing and motion sensing logic.

It is noted that the Chain Feed Latch can be reset by yet another signal, namely by the occurrence of a JAMF signal from a Jam Detection Latch (in Jam Logic 606) provided by line L534, AND gate 526, and inverting gates 528 and 530 to the "D" node of the Chain Feed Latch. AND gate 526 is used to require that a jam is here occurring in the LDC Mode. Thus anytime paper jam occurs, the $\overline{\text{JAMF}}$ signal goes to a logical "0", and the Chain Feed Latch is immediately reset so that the Program Counter is inhibited as well as motion sensing and billing functions. The Jam Logic 606 may be activated by either a paper jam from the Motion Sensing Circuit 600 or an optical carriage jam from the Failsafe Timer 608. The Failsafe timer provides a three second interval to allow the carriage time to go from the Home position to the End of Scan position. If the carriage has not reached the End of Scan position within the allotted time the JAM Latch is reset. As the LDC Mode uses a fixed Optical System the Failsafe Timer is only significant in BASE Mode operations and in mode changing operations.

The utilization of a separate counter or second timing meas, such as the Program Counter used herein, enables a much faster chain feeding operation than is possible, for example, in the LDC Mode — Large Cassette wherein only a single counter or single timing means is utilized. The single counter operation is shown in reference to FIGS. 5C and 5D.

As the Motion Sensing and Billing operations are controlled by the Master Counter in the LDC/LC Mode, one must wait for these processes to finish before entering a subsequent document. In all modes of operation, one must wait for the exposure lamp to be deenergized before exposure of a second document. The exposure lamp in the LDC Mode is always deenergize 13 master clock pulses after the Done Latch is reset (low); however, for large cassettes the Done Latch is reset only after motion sensing operations are complete. (For Documents larger than 15 inches, the Done Latch is reset by the Trailing Edge Switch). Thus, it is noted in comparing FIGS. 5A and 5B with FIGS. 5C and 5D that by utilizing a separate counter to control motion sensing and billing one may save at least 157 counts or 157/60 = 2.6 seconds over the normal time one would have to wait before feeding a subsequent copy for documents less than 15 inches. Obviously such a savings greatly improves machine efficiency when copies are desired of original documents successively and automatically feed into the copier/duplicator.

The Develop Simulate Latch

In order to be able to expose a second document feed into the document feeding means immediately after the exposure of the prior first document, the LDC LOGIC 302 must be fooled, so to speak, into believing that the development process for the first copy is complete so a subsequent paper feed (and exposure, etc.) can be initiated. The Develop Simulate Latch serves the function of logically providing a signal simulating completion of development at CT13M-SQ3 even though the Develop Latch is not actually reset until deactuation of the Trailing Edge Switch at approximately CT52P.

To achieve the desired simulation, the Develop Simulate Latch is set at Coincidence (CT141M-SQ2) as described above. The feeding of a second document at CT13M-SQ3 does nothing to the Develop Simulate Latch, and thus its "Q" output remains high. This high signal is fed to the *a* input of a NAND gate 524, via line L536 which has its *b* input fed by the Done Latch via line L522. Since the Done Latch is set by the Document Switch upon feeding in the second copy, the *b* input to NAND gate 524 is also high driving the output of NAND gate 524 low. The low output of NAND gate 524 is fed to the *b* input of NAND gate 502 whose *a* input is fed by the high DEVF signal from the Develop Latch. However, the low signal at the *b* input to NAND gate 502 drives its output high, and this high signal is fed to NAND gate 241 via line L506 to simulate that development is completed. Thus the Scan Latch can be set at CT13M-SQ2 as in the first document cycle. In effect a high logic level must be present on line L506 before the Scan Latch can be set. In the first document case, the high level was present because development had not yet started and the Develop Latch supplied a low signal to the *a* input of NAND gate 502. In the second document case when development is taking place, a low signal is applied to the *b* input of NAND gate 502 as result of the Done Latch and Develop Simulate Latch both being set (high).

The LDC Exposure Latch is also set at CT16M-SQ2 as described above for the first document. At CT20M, the Master Counter is reset via NAND gate 261, NOR gate 263, inverting gate 264 and One Shot 213 as in the first copy case. Also, at CT20M-SQ2, the Develop Simulate Latch is reset by the $\overline{\text{CT20M}}$ signal via line L510 to AND gate 522 and the "D" node of the Develop Simulate Latch. The $\overline{\text{CT20M}}$ signal also resets the Scan Latch through the One Shot 213 as before. The Develop Latch in the BASE LOGIC is now set at CT8M-SQ2 after the Master Counter reset (CT20M), but as the Develop Latch is still set from the first copy, the Develop Latch simply remains on without ever getting reset. (Recall that the Trailing Edge Switch resets the Develop Latch, but only if the Done Latch is reset indicating no subsequent document has been fed-in.)

It is thus seen that the utilization of a separate counter, the Program Counter, in combination with the Develop Simulate Latch enable the Chain Feed Logic 400 to expose a second document orginal immediately after completion of the first document exposure.

Certain modifications and improvements of the instant invention will be apparent to those of skill in the art and the claims are intended to cover all such modifications and improvements which do not depart from the spirit or scope of the invention.

I claim:

1. A multi-mode copier/duplicator comprising:

an optical system for operation of said copier/duplicator in a first mode for copying a document up to a first size onto a copy sheet up to said first size or for copying a document up to a second size larger than said first size onto a copy sheet up to said second size;

document feeding means operative in said first mode for moving documents relative to said optical system;

first sensing means for sensing a document at said document feeding means;

second sensing means for sensing whether said copy sheets are up to said first size or are larger than said first size up to said second size;

first timing means for controlling in said first mode a first portion of said copier/duplicator machine cycle;

second timing means for controlling in said first mode a second portion of said copier/duplicator machine cycle responsive to said second sensing means sensing said copy sheets up to said first size; and said first timing means in said first mode being responsive to said second sensing means sensing copy sheets up to said first size and to said first sensing means for automatically starting said first portion of said copier/duplicator machine cycle during and simultaneously with said second portion of said copier/duplicator machine cycle.

2. A multi-mode copier/duplicator as recited in claim 1, wherein said first timing means controls said first and second portions of said copier/duplicator machine cycle responsive to said copy sheet sensing means sensing copy sheets larger then said first size up to said second size.

3. A multi-mode copier/duplicator as recited in claim 1, wherein said copier/duplicator is a xerographic photocopy machine having charging means, exposure means including said optical system, copy sheet feeding means, development means, copy sheet jam sensing means and billing means, and wherein said first timing means comprises means for controlling said copy sheet feeding means.

4. A multi-mode copier/duplicator as recited in claim 3 wherein said first timing means further comprises means for controlling said charging means.

5. A multi-mode copier/duplicator as recited in claim 4 wherein said first timing means further comprises means for activating said development means.

6. A multi-mode copier/duplicator as recited in claim 5 wherein said first timing means further comprises means for controlling said exposure means.

7. A multi-mode copier/duplicator as recited in claim 5 wherein said second timing means comprises means for controlling said copy sheet jam sensing means.

8. A multi-mode copier/duplicator as recited in claim 5 wherein said second timing means comprises means for controlling said billing means.

9. A multi-mode copier/duplicator as recited in claim 3 wherein said second timing means comprises means for controlling said copy sheet jam sensing means and said billing means.

10. A multi-mode copier/duplicator as recited in claim 9 wherein said xerographic photocopy machine has fuser means and said second timing means further comprises means for actuating said fuser means.

11. A multi-mode copier/duplicator as recited in claim 1, wherein said optical system comprises an exposure means and wherein said second portion of said copier/duplicator machine cycle begins deactuation of said exposure means by said first timing means.

12. A multi-mode copier/duplicator as recited in claim 1, wherein said copier/duplicator is a xerographic photocopying machine having charging means, exposure means including said optical system, copy sheet feeding means, development means, copy sheet jam sensing means, and billing means, and said first timing means comprises:

a first counter means for controlling said charging means, exposure means, copy sheet feeding means and actuation of said development means, and said second timing means comprises:

a second counter means for controlling said copy sheet jam sensing means and said billing means.

13. A multi-mode copier/duplicator as recited in claim 12, wherein said copier/duplicator comprises:

a sheet feeding logic circuit for activation of said copy sheet feeding means, said sheet feeding logic circuit responsive to the deactivation of said development means when operating with copy sheets larger than said first size, and a simulation logic circuit operative when employing copy sheets up to said first size for logically simulating the deactivation of said development means before actual deactivation of said development means, said simulation logic circuit connected to said sheet feeding logic circuit, whereby said sheet feeding logic circuit is operative for activation of said copy sheet feeding means before the actual deactivation of said development means.

14. A multi-mode copier/duplicator as recited in claim 12, wherein said xerographic photocopy machine has fusing means and wherein said second counter is operative to actuate said fusing means in response to said second sensing means sensing copy sheets up to said first size.

15. A multi-mode copier/duplicator as recited in claim 12, wherein said xerographic photocopy machine has fusing means and wherein said first counter is operative to actuate said fusing means in response to said second sensing means sensing copy sheets larger than said first size up to said second size.

16. A multi-mode copier/duplicator as recited in claim 1, wherein said optical system includes means for scanning fixed documents in a base mode of operation.

17. A multi-mode copier/duplicator as recited in claim 13 wherein said second portion of said copier/duplicator machine cycle begins upon deactivation of said exposure means by said first timing means.

18. A multi-mode copier/duplicator as recited in claim 16 wherein said first timing means is operative for controlling said first and second portions of said copier/duplicator machine cycle in said base mode of operation.

19. A chain feeding control logic circuit for a copier/duplicator machine comprising:

first counter means for controlling said copier/duplicator machine during one portion of a copier/duplicator machine cycle, second counter means for controlling said copier/duplicator during one other portion of a copier/duplicator machine cycle, means for actuating said second counter means at a predetermined count of said first counter means, and means for initializing said first counter means for controlling said one portion of said copier/duplicator machine cycle simultaneously with said one other portion of said copier/duplicator machine cycle.

20. A multi-mode copier/duplicator as recited in claim 19 wherein said one portion of said copier/duplicator cycle comprises activation and deactivation of exposure means and wherein said one other portion of said copier/duplicator machine cycle begins upon deactivation of said exposure means.

21. A multi-mode copier/duplicator as recited in claim 20 wherein said copier/duplicator is a multi-mode machine having a fixed optical system for operation with a large paper cassette and a small paper cassette and a moving optical system for operation with a small paper cassette.

22. A multi-mode copier/duplicator as recited in claim 21 wherein said first counter means is operative for controlling said copier/duplicator machine in said one and other portion of said machine cycle during operation with said large paper cassette.

23. A method of successively copying documents in a multi-mode copier/duplicator machine comprising the steps of:

in a first mode of operation:

feeding a first document into document feeding means, controlling one group of machine parameters in one portion of a machine cycle, independently controlling a second, following group of machine parameters in a subsequent portion of a machine cycle, upon feeding a second document into said document feeding means while controlling said second group of machine parameters, substantially immediately controlling said one group of machine parameters simultaneously with the independent controlling of said second group, and in a second mode of operation:

controlling at any given time only one of said one and second groups of machine parameters.

24. A method of successively copying documents in a multi-mode copier/duplicator machine as recited in claim 23 wherein controlling said one group of machine parameters comprises controlling the steps of:

charging a photoreceptor, exposing said first document and photoreceptor whereby a charge image is formed on said photoreceptor, feeding copy paper into said copier/duplicator machine, and activating development means in said copier/duplicator.

25. A method of successively copying documents in a multi-mode copier/duplicator machine as recited in claim 23 wherein controlling said second group of machine parameters comprises controlling the steps of:

sensing copy paper jam conditions and billing for copies made in said copier/duplicator.

26. A method of successively copying documents in a multi-mode copier/duplicator machine as recited in claim 25 wherein controlling said second group of parameters comprises controlling the step of fusing said copy paper.

* * * * *